US005376259A

United States Patent [19]

Kline et al.

[11] Patent Number: 5,376,259

[45] Date of Patent: * Dec. 27, 1994

[54] STAGED CATALYST PROCESSING TO PRODUCE OPTIMUM AROMATIC BARREL PER CALENDAR DAY AROMATIC PRODUCTION

[75] Inventors: Jules M. Kline, San Anselmo; Stephen J. Miller, San Francisco; Bernard F. Mulaskey, Fairfax, all of Calif.

[73] Assignee: Chevron Research and Technology Company, San Francisco, Calif.

[ * ] Notice: The portion of the term of this patent subsequent to Dec. 17, 2009 has been disclaimed.

[21] Appl. No.: 733,342

[22] Filed: Jul. 22, 1991

Related U.S. Application Data

[63] Continuation-in-part of Ser. No. 488,333, Mar. 2, 1990, Pat. No. 5,073,250, and Ser. No. 488,155, Mar. 2, 1990, Pat. No. 5,171,691.

[51] Int. Cl.[5] ..... C10G 35/06; C10G 35/085; C10G 35/095

[52] U.S. Cl. ..... 208/65; 208/138; 585/322; 585/407; 585/419

[58] Field of Search ..... 208/65, 138; 436/55; 585/322, 407, 419

[56] References Cited

U.S. PATENT DOCUMENTS

| | | | |
|---|---|---|---|
| 4,922,048 | 5/1991 | Harandi | 585/310 |
| 4,927,525 | 5/1990 | Chu | 208/138 |
| 4,929,332 | 5/1990 | Moser et al. | 208/65 |
| 4,929,333 | 5/1990 | Moser et al. | 208/65 |
| 4,985,132 | 1/1991 | Moser et al. | 208/65 |
| 5,073,250 | 12/1991 | Kline et al. | 208/65 |

*Primary Examiner*—Helane Myers
*Assistant Examiner*—Walter D. Griffin
*Attorney, Agent, or Firm*—Fliesler, Dubb, Meyer & Lovejoy

[57] ABSTRACT

A naphtha feed is contacted in a penultimate aromatic forming stage under catalytic aromatic forming conditions with a first catalyst. The effluent from the penultimate stage is contacted in a final aromatic forming stage under catalytic aromatic forming conditions and at substantially the same pressure as is maintained in the penultimate stage with a second catalyst. The pressure is selected to provide optimal aromatic production per calendar day from the final stage.

14 Claims, 11 Drawing Sheets

STAGED CATALYST PROCESSING TO PRODUCE OPTIMUM AROMATIC BARREL PER CALENDAR DAY AROMATIC PRODUCTION

CROSS-REFERENCE

This application is a continuation-in-part of copending applications Ser. Nos. 07/488,333 filed Mar. 2, 1990 now U.S. Pat. No. 5,073,250 and 07/488,155 filed Mar. 2, 1990 now U.S. Pat. No. 5,171,691, both of which are incorporated herein by reference.

FIELD OF THE INVENTION

The present invention relates to a multistage catalytic aromatic production process using a catalyst in the final stage which is particularly effective to dehydrocyclize $C_6$–$C_8$ normal and slightly branched chain paraffins. The penultimate (next-to-last) and final stages are operated at a single pressure which provides optimum aromatic barrel per calendar day (AB/CD) operation.

BACKGROUND OF THE INVENTION

Dehydrocyclization is a well known reaction wherein alkanes are converted to aromatics. For example, hexane may be dehydrocyclized to benzene, heptane to toluene, etc.

Catalytic reforming is a well-known refinery process for upgrading light hydrocarbon feedstocks, frequently referred to as naphtha feedstocks. Products from catalytic reforming can include high octane gasoline, useful as automobile fuel, and/or aromatics, such as benzene and toluene, useful as chemicals. Reactions typically involved in catalytic reforming include dehydrocyclization, isomerization and dehydrogenation. The dehydrocyclization and dehydrogenation reactions lead to the production of aromatics starting, respectively, from linear and slightly branched alkanes of a proper size, e.g., 6–8 carbon atoms and from cycloalkanes, e.g., cyclohexane and methyl-, dimethyl- and ethylcyclohexanes. Because typical petroleum feedstocks are much richer in linear and slightly branched alkane than in cycloalkanes, dehydrocyclization tends to be the more important of these reactions. Thus, reforming typically includes dehydrocyclization. However, dehydrocyclization or aromatization of alkanes can be directed more narrowly than reforming.

For a long period of time, the leading catalyst used in reforming was platinum on an alumina-halide support. This catalyst had some sensitivity to sulfur, but modest amounts of sulfur, such as 10 to 100 ppm or more were acceptable and sometimes preferred.

In the late 1960's and early 1970's, a catalyst was introduced which had more sensitivity to sulfur. This catalyst contained platinum and rhenium, generally on an alumina-halide support. This catalyst was found to perform best at sulfur levels in the feed below 10 ppm, preferably below 1 ppm; see U.S. Pat. No. 3,415,737 to Kluksdahl. The catalyst preferably was sulfided prior to use in catalytic reforming.

More recently, U.S. Pat. No. 4,634,518 to Buss and Hughes disclosed a process for catalytic reforming and/or dehydrocyclization/aromatization wherein the catalyst is even more sensitive to sulfur than the platinum rhenium catalyst. The U.S. Pat. No. 4,634,518 process uses a catalyst such as platinum on a large pore crystalline aluminosilicate zeolite, such as L-zeolite. Preferably, the sulfur is maintained at less than 0.1 ppm in the feed to the aromatization process. See U.S. Pat. No. 4,456,527 to Buss, Field and Robinson.

U.S. Pat. No. 4,835,336 to McCullen discloses sulfiding a noble metal/low acidity medium pore size zeolite catalyst to suppress hydrogenolysis and increase aromatic selectivity of the catalyst. The silica to alumina ratio according to the '336 patent is at least 12. The example in the '336 patent discloses a silica to alumina ratio of 26,000. The amount of alkali in the '336 catalyst is not disclosed in the Example in that patent. With regard to inclusion of alkali in the '336 catalyst, the '336 patent teaches at column 6, line 9:

> "the low acidity zeolite (for example, ZSM-5) can be synthesized to have a low aluminum content, or may be exchanged with Group IA or IIA cations to reduce acidity."

At column 12, line 1, the '336 patent teaches:

> "the zeolites used as catalysts in this invention may be in the hydrogen form or they may be base exchanged or impregnated to contain ammonium or a metal cation complement. The metal cations that may be present include any of the cations of the metals of Group I through VIII of the periodic table. However, in the case of Group IA metals, the cation content should in no case be so large as to substantially eliminate the activity of the zeolite for the catalysts being employed in the instant invention."

Japanese Kokai 115087, laid open May 26, 1987, discloses the use of a high silica to alumina ratio zeolite for reforming. The catalyst contains a Group IIB metal and is presulfided.

Another reference which discloses the use of zeolitic catalyst in aromatization or dehydrocyclization reaction is U.S. Pat. No. 4,347,394, to Detz and Field. The catalyst disclosed for use in the process of the '394 Detz and Field patent contains a crystalline aluminosilicate which is commonly referred to as silicalite. Silicalite is generally regarded as having the same basic X-ray diffraction pattern as the well-known zeolite ZSM-5. ZSM-5 is disclosed in U.S. Pat. No. 3,702,886 to Argauer. However, the ratio of silica to alumina for silicalite is higher than is the silica/alumina ratio for typical ZSM-5 catalyst.

According to the Detz and Field patent cited above, the sulfur in the feed is low, less than 0.2 ppm for feed 1, as disclosed in Column 5 of that patent, and less than 0.02 ppm for feed 2. Also, the acidity of the catalyst is low, so that the catalyst is referred to as a non-acidic catalyst. According to the Column 6 examples in the Detz and Field patent, the amount of alkali used in the catalyst is not necessarily low. Thus, Column 6, Experiments A, B and C, show that 0.017 wt. % sodium was too low a sodium value to produce good yields of $C_5$+ and of benzene, whereas, at higher sodium values better yields resulted. At 0.99 wt. % sodium in the catalyst, the $C_5$+ yield and benzene yield improved substantially and at 4.12 wt. % sodium, the improvement was even greater.

As will be seen from the description below, the present invention requires the use of catalysts that are sulfur tolerant.

U.S. Pat. No. 4,680,280 to Pandey and Buss discloses the addition of molybdenum to zeolite L-catalytic reforming catalyst as a means of improving sulfur tolerance. U.S. Pat. No. 4,579,831 to field discloses a sulfur resistant catalyst comprising a zeolite bound with alumina containing an alkali or alkaline earth component.

U.S. Pat. No. 4,401,555 to Miller is directed to olefin production from paraffins using silicalite having a low sodium content. The silicalite used in the '555 process contains less than 0.1 wt. % sodium and is composited in a matrix which is substantially free of cracking activity. Also, the composite has no hydrogenation component. According to the '555 process, the feed can be hydrotreated to reduce sulfur to less than 100 ppm organic sulfur.

U.S. Pat. No. 4,851,605 to Bortiger, et al discloses a method of making a zeolite, such as ZSM-5, on a pH controlled sodium free basis. The catalyst of U.S. Pat. No. 4,851,605 is used in a process to synthesize olefins from methanol and/or dimethyl ether.

SUMMARY OF THE INVENTION

In accordance with the present invention a process is provided for catalytic processing of feed hydrocarbons to produce a product having a relatively high aromatics content. The process comprises contacting the feed in a penultimate aromatics forming stage under catalytic aromatics forming conditions with a first catalyst comprising a Group VIII metal dispersed on an inorganic oxide support; and contacting the effluent from said penultimate stage in a final stage under catalytic aromatics forming conditions and at substantially the same pressure as is maintained in said penultimate aromatics forming stage with a second catalyst comprising a noble metal dispersed on an inorganic oxide support. The pressure in the penultimate and final stages is selected to provide optimal AB/CD production of product of a desired aromatics content and/or for a specified run length, from the final stage.

In accordance with the present invention it is possible to significantly increase AB/CD yield from a given feed at a given aromatics content without the significant equipment expenditures necessary if the penultimate and final zones were each to be operated under optimum aromatics liquid volume yield conditions (different pressures) for each particular catalyst in each particular stage. While aromatics liquid yield is slightly deleteriously affected by operating in accordance with the present invention the lighter components formed as by-products are also useful either in the refinery or elsewhere. In accordance with the invention the penultimate and final stages are run so that the catalyst life, as may be conveniently estimated from fouling rate measurements over a limited period of time, in one stage is equal to that in the other. As a result, each stage is ready for regeneration, or the catalyst is ready for replacement, at the same time, therefore greatly reducing downtime. By reducing downtime, of course, the AB/CD is increased. Furthermore, the Research Octane Number (RON) of the effluent from the penultimate stage is advantageously selected so that AB/CD for the multistage process is optimized.

BRIEF DESCRIPTION OF DRAWINGS

The invention will be better understood by reference to the drawings, wherein.

DETAILED DESCRIPTION OF THE INVENTION

Figure 1:
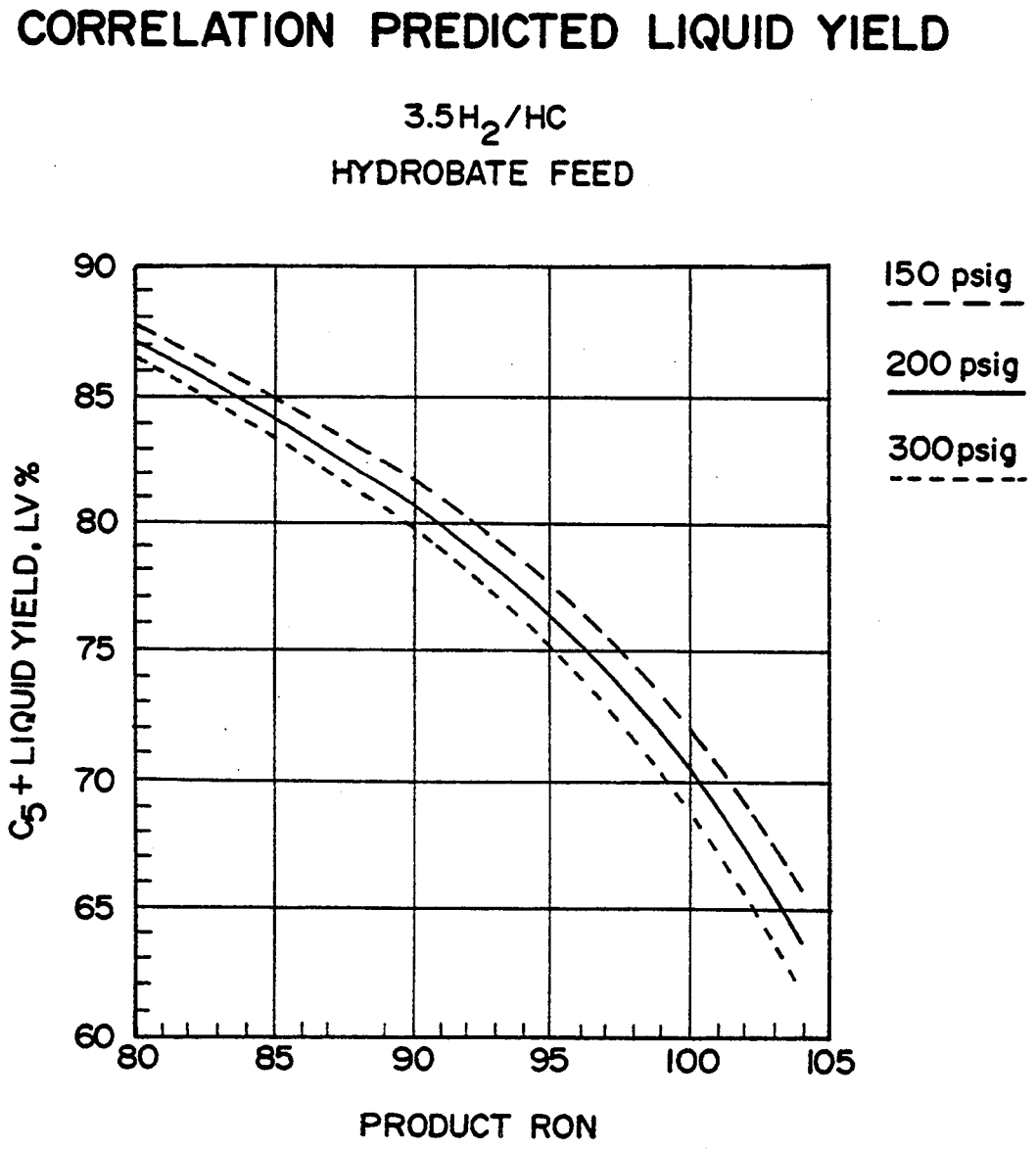
FIG. 1 illustrates, graphically the relationship between $C_5+$ liquid volume yield and RON of product at three different pressures for a hydrobate feed.

As stated previously the present invention utilizes a process wherein both a penultimate and a final aromatics forming stage are operated at the same pressure and that pressure is selected to optimize the aromatics barrel per calendar day (AB/CD) of the overall process.

While the process of the present invention is useful for forming any of a number of aromatic compounds or mixtures thereof, specifically benzene, toluene, xylenes and ethylbenzene, it will often be advantageous to utilize a feedstock which will be selected to optimize production of a single such aromatic, for example, benzene, whereby the final product can be more readily separated from other products to provide a relatively pure chemical.

For convenience, the following description will center on the production of benzene. This is done for convenience and is not done in any limiting sense. Thus, the other aromatics mentioned herein can likewise be produced in accordance with the present invention.

Each stage utilizes a single type of catalyst and a single set of operating conditions. Different stages can use the same or different catalysts and operating conditions subject to each stage operating at nominally the same pressure. Successive stages can have both the same operating conditions and the same catalyst but only in the situation where interstage heating is needed and used to return the feed to a desired temperature after it has been cooled due to the endothermic nature of some of the reactions taking place. Such interstage heating is commonly used when the temperature has dropped 35° F. or more, e.g., about 35° to about 100° F., in any one stage. It should be noted that while each stage is characterized as being run at the same pressure it should be realized that the pressures will not be identical due to pressure drops across the bed or beds constituting the penultimate stage and to pressure drops in any interstage heaters.

Generally the pressure will fall within a range from about 30 psig to about 350 psig, and more preferably from about 50 psig to about 300 psig.

Note that while the discussion which follows relates at times, for convenience, to use of the method of the invention for controlling the operating parameters of the penultimate and final reforming stages, the principles of the invention are applicable as between any two successive stages and can be applied to several sequentially connected aromatization stages. In essence then, the term final stage as used herein does not necessarily indicate the last stage if there are three or more stages, but rather indicates a succeeding stage which follows a preceding (often referred to for convenience as "penultimate") stage.

Any of a number of catalysts can be utilized in both the penultimate stage and the final stage. The penultimate stage catalyst normally includes a Group VIII metal on an inorganic oxide support, for example, platinum or palladium on alumina, on silica/alumina or on a zeolite, often with a promoter metal such as rhenium, tin or iridium. A conventional catalyst of the nature usually used in reforming hydrocarbon feeds may be used in the penultimate stage and may comprise a Group VIII metal, more preferably a noble metal, most preferably platinum. Preferably, the conventional catalyst also comprises a promoter metal, such as rhenium, tin, germanium, cobalt, nickel, iridium, rhodium, ruthenium, or combinations thereof. More preferably, the promoter metal is rhenium or tin. These metals are disposed on a support. Preferable supports include alumina, silica/alumina, silica, natural or man-made zeolites, more preferably, the support is alumina or a zeolite. The catalyst may also include between 0.1 and 3 weight percent chloride, more preferably between 0.5 and 1.5 weight percent chloride. The catalyst, if it includes a promoter metal, suitably includes sufficient promoter metal to provide a promoter to platinum ratio between 0.5:1 and 10:1, more preferably between 1:1 and 6:1, most preferably between 2:1 and 3:1. The precise conditions, compounds, and procedures for catalyst manufacture are known to those persons skilled in the art. Some examples of conventional catalysts are shown in U.S. Pat. Nos. 3,631,216; 3,415,737; and 4,511,746, of Mulaskey, et al which are hereby incorporated by reference in their entireties.

The final stage catalyst can comprise any of a number of different catalysts which are selected for dehydrocyclization activity. Typical of such catalysts are the intermediate pore zeolites such as those of the ZSM series.

It is particularly preferred that the final stage catalyst be sulfur tolerant. Sulfur tolerance is used herein primarily to connote that the catalyst may be exposed to substantial amounts of sulfur, such as more than 2 ppm sulfur and return to relatively high activity after the exposure to high sulfur levels is discontinued. Preferably the catalyst should also be resistant to sulfur poison or deactivation with sulfur levels in the range of about 0.1 to 2 ppm sulfur. Thus, in addition to the catalyst having the capability of "bouncing back" in activity after discontinuance of sulfur in the feed, the catalyst should also "resist" or tolerate as a steady component in the feed, up to 0.5 ppm sulfur, more preferably up to 1 ppm sulfur, most preferably up to 2 ppm sulfur. Accordingly, the terminology "sulfur tolerant" is used herein to embrace the catalyst's ability to regain activity after discontinuance of exposure to sulfur and also the catalyst's ability to perform well (low fouling rate and good activity) in the presence of moderate amounts of sulfur.

The sulfur tolerance can be utilized in various ways. The feed to the process may contain relatively high amounts of sulfur compared to feed to other catalytic reforming or dehydrocyclization processes using zeolitic-base catalysts, or the feed may be subject to periodic exposure to high amounts of sulfur (and hence the stage is subjected to periodic high amounts of sulfur).

By "periodic exposure" is meant sulfur increases in the feed and hence in the processing zone, for example, due to upsets in desulfurization step upstream of the catalytic benzene producing zones, or breakthroughs or notable rises in the amount of sulfur in the feed due to upstream sulfur removal steps, or simply due to changes in the base feedstock to the refinery or processing zone. "Periodic" exposure is used to connote exposure to the specified sulfur levels for a significant period of time as opposed to continuous exposure to sulfur. A significant period of time would specifically be at least two minutes, more typically an hour or more.

When one operates in accordance with the present invention and using the preferred highly sulfur tolerant final stage catalyst the feed to the penultimate stage can have a sulfur content which is dictated by the sulfur resistance of the catalyst used in the penultimate stage. Therefore, the overall need to reduce sulfur to the feed to the penultimate stage is not increased because of the presence of the final stage with its dehydrocyclization type catalyst.

To understand the present invention it is first necessary to review the definition of the term octane barrel per calendar day (OB/CD) as it is used herein. This term is defined by the equation $$OB/CD = IB \times \frac{LV\%\ \text{yield}}{100} \times \frac{RL}{(RL + RgT)} \times (FRON - PRON)$$

where

IB = barrels of input naphtha to the reforming operation per operating day,

LV % = liquid volume percent yield of $C_5+$ (pentane and higher boiling materials) from the reforming operation, RL = run length, i.e., the length of time between regenerations (or replacements), RgT = time needed to regenerate (or replace) both catalysts, FRON = the RON of the final stage $C_5+$ reformate, and PRON = the pool RON (for a given refinery).

Basically the higher the OB/CD, as calculated above, the greater the ability of the refiner to increase the octane and/or volume of product. The terms which can be varied or specified in this equation are the LV % yield of $C_5+$, run length between regenerations, the time needed to accomplish regeneration and the RON of the second stage. Varying the pressure affects these quantities.

The liquid volume percent yield of $C_5+$ is determined by the conditions under which the catalyst is being used. The regeneration time can be minimized by assuring that the catalyst in both the final stage and in the stages which precede the final stage are run under such conditions that they need regeneration, or the catalyst needs replacement, at the same time. This is done taking into account life, e.g., fouling rate, information for each catalyst which is a measurable quantity. Thus, there are a number of variables which must be controlled and since these are not wholly independent variables, they must be controlled together. In accordance with the present invention the liquid volume percent yield of $C_5+$ is generally not optimized because of the necessity for optimizing the other components of the above equation. Surprisingly, it has been found that the LV % yield of $C_5+$ is generally sufficiently close to its maximum value so that each barrel of input naphtha is efficiently converted to $C_5+$ reformate.

In one embodiment the run length may be determined by how long it is economical to run between regenerations in a particular aromatization operation, in which case the final stage product aromatic content is dictated by this consideration.

In another embodiment it may be necessary to produce a very high aromatic content product, in which instance a shorter run length may be dictated to provide such a product.

In either instance the OB/CD, and thereby the AB/CD, is optimized in accordance with the present invention under the selected external constraint. Often, it will be possible to satisfy both of these constraints, that is, to produce product of a desired RON and to be able to operate for a long enough time between regenerations so as to allow economical operation of the process.

In order to carry out the present invention the life of the catalyst (which is often estimated by measuring the fouling rate over a limited time period which is shorter than the run length) must be known under controlled conditions, for example, at constant LHSV as a function of the change in RON from that of the feed to each stage to that of the $C_5+$ effluent from each stage. Usually this will be determined as a function of the pressure in each stage. Thus, catalyst life for the penultimate stage catalyst must be known at constant LHSV for a given naphtha feed RON to that stage, for example an RON of 50, as a function of the change in RON from that of the feed to the penultimate stage to that of the $C_5+$ effluent from the penultimate stage and usually as a function of the pressure in the penultimate stage. Similarly, the catalyst life for the final (dehydrocyclization) stage catalyst must be known at constant LHSV as a function of the change in RON from that of the $C_5+$ effluent from the penultimate stage to that of the $C_5+$ effluent from the final stage (the product RON) and usually as a function of the final stage operating pressure.

Once both of these relationships are determined the designer can select the penultimate stage $C_5+$ effluent RON to be such that the lives of the penultimate and final stage catalysts are substantially equal, generally taking into account the first and second stage pressures. This thereby minimizes needless down time for regeneration and/or replacement of catalyst.

Very preferably, in order to more fully optimize OB/CD, and thereby AB/CD, the yield of $C_5+$ effluent from the penultimate stage is also determined as a function of the penultimate stage operating pressure and the yield of $C_5+$ effluent from the final stage is determined as a function of final stage pressure. When this is known the operating pressures of the penultimate and final stages are chosen to be the same and within about 30%, more preferably within about 15%, of that which gives the highest OB/CD and thereby also gives the highest AB/CD. Of course it is generally preferable to operate as close to the optimum OB/CD as possible. However, significant improvement in production is provided over known processes by operating within 30% of the highest OB/CD.

One can carry out the method of the present invention by determining at constant LHSV the catalyst life for the penultimate stage catalyst for a given feed RON as a function of the RON of the $C_5+$ effluent from the penultimate stage and as a function of the penultimate stage operating pressure. In practice this can be done by running a series of experiments wherein the LHSV is kept constant as is the operating pressure and fouling in degrees per hour is determined to maintain the RON of the $C_5+$ effluent from the penultimate stage at a selected value. This can then be repeated again at a series of different pressures until a graphical or other representation can be developed of life versus $C_5+$ effluent RON for the penultimate stage. Also, at constant LHSV the catalyst life for the final stage catalyst is determined as a function of the change in RON from that of the $C_5+$ effluent from the penultimate stage to that of the $C_5+$ effluent from the final stage and of the final stage operating pressure. This also can be repeated at a series of pressures as with the penultimate stage life determining step.

For the penultimate stage the relationship between $C_5+$ liquid yield and penultimate stage $C_5+$ effluent RON can then be determined at a series of pressures. Such data can often be developed by the use of appropriate computer modeling programs and the data in FIG. 1 was derived in this manner. FIG. 1 shows this data at pressures of 150, 200 and 250 psig for a feed to the penultimate stage which has an initial RON of 50 under the conditions specified in FIG. 1. Similar information can be obtained or reasonably accurately estimated for other feeds and for other operating conditions.

Figure 2A:
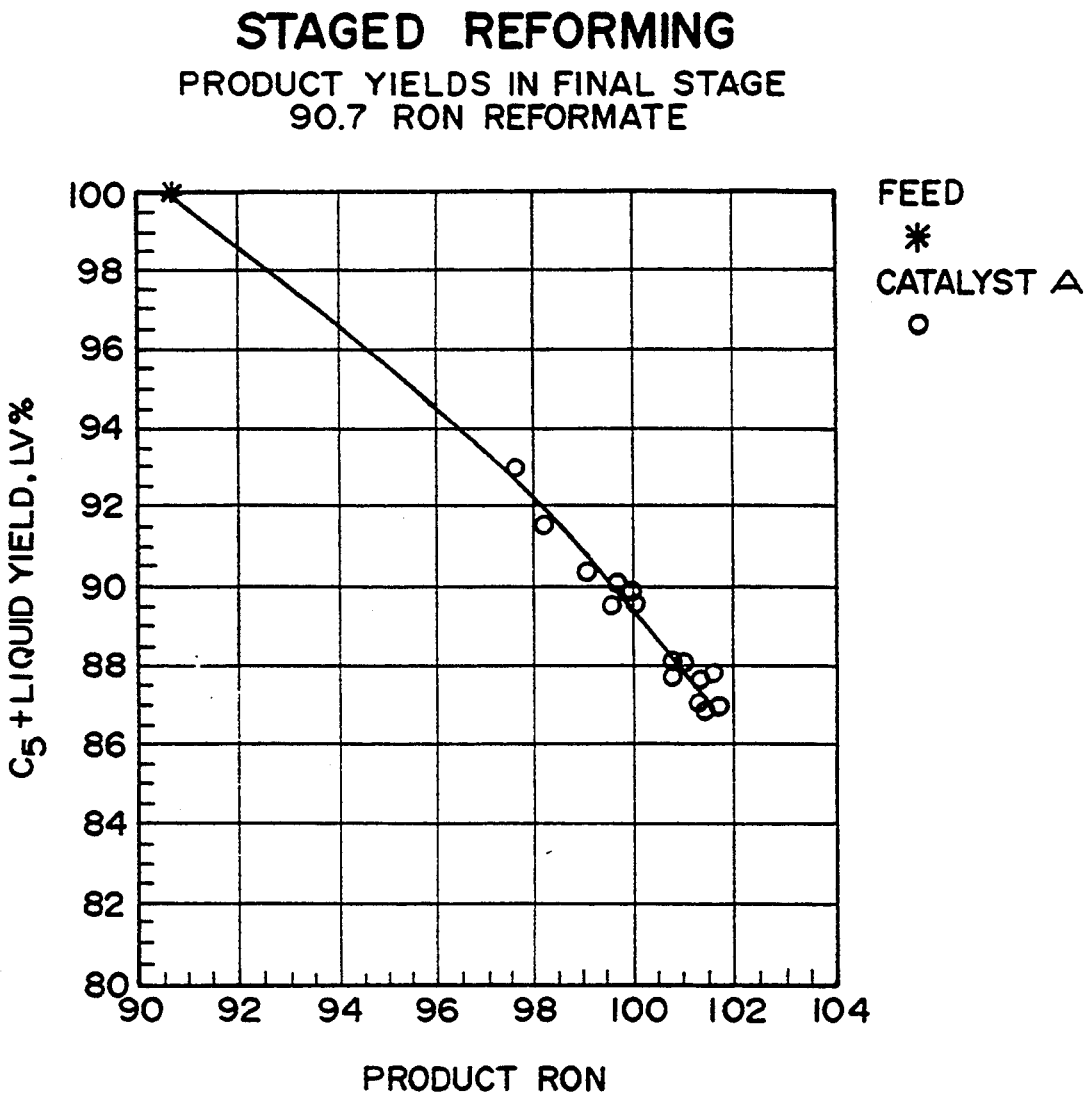
FIG. 2A illustrates, graphically the relationship between $C_5+$ liquid volume yield and RON of product for a 90.7 RON feed using a conventional platinum/rhenium/alumina catalyst.
Figure 2B:
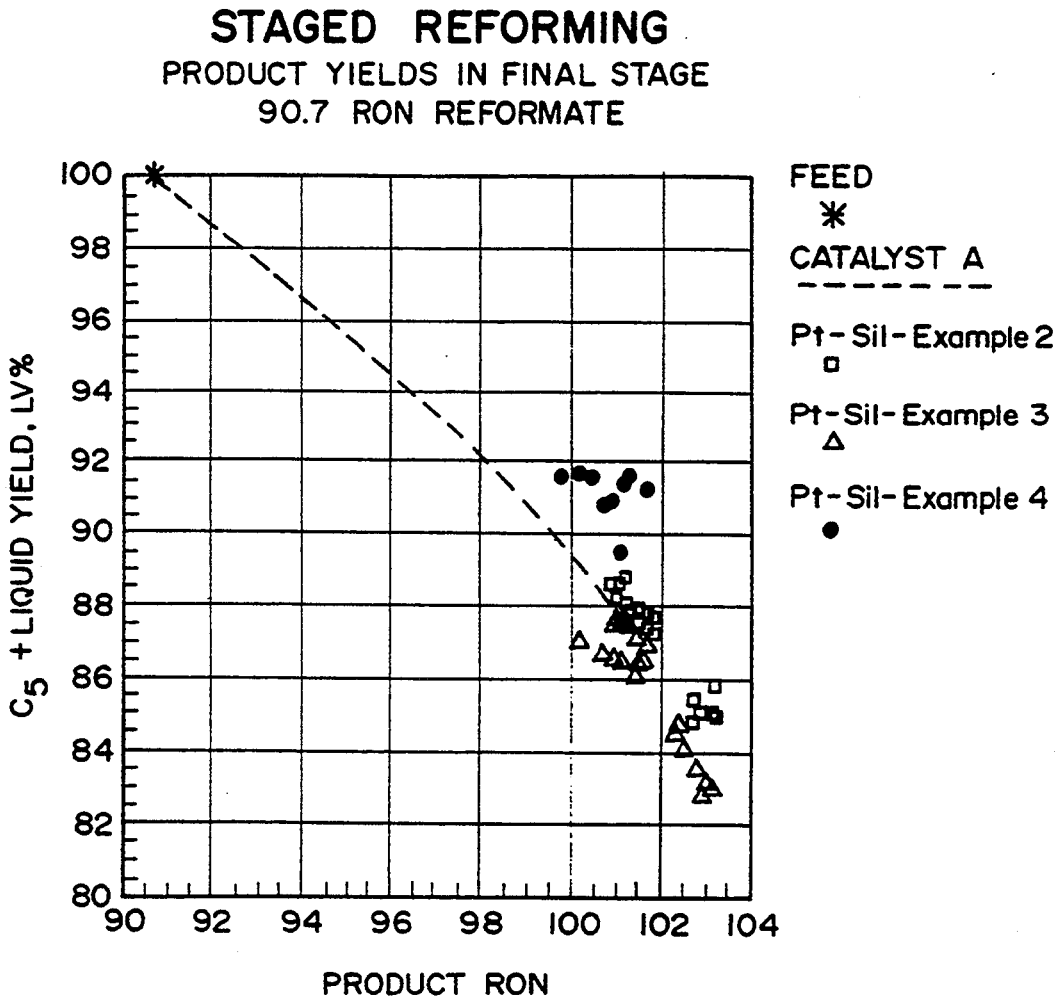
FIG. 2B illustrates, graphically the relationship between $C_5+$ liquid volume yield and RON of product for a 90.7 RON feed using three platinum/silicalite catalysts.

Similarly, for the final stage the relationship between yield in the final stage and the product RON is determined at a series of pressures. Overall $C_5+$ liquid yield is the product of the $C_5+$ liquid yield in the penultimate stage and the $C_5+$ liquid yield in the final stage. FIGS. 2A and 2B show final stage $C_5+$ liquid yield curves obtainable in this manner for a conventional platinum/rhenium/alumina catalyst (labelled "A") at 200 psig and for platinum/silicalite catalysts at 60 and at 70 psig starting with an effluent from a previous stage or stages which has an RON of 90.7.

Figure 3A:
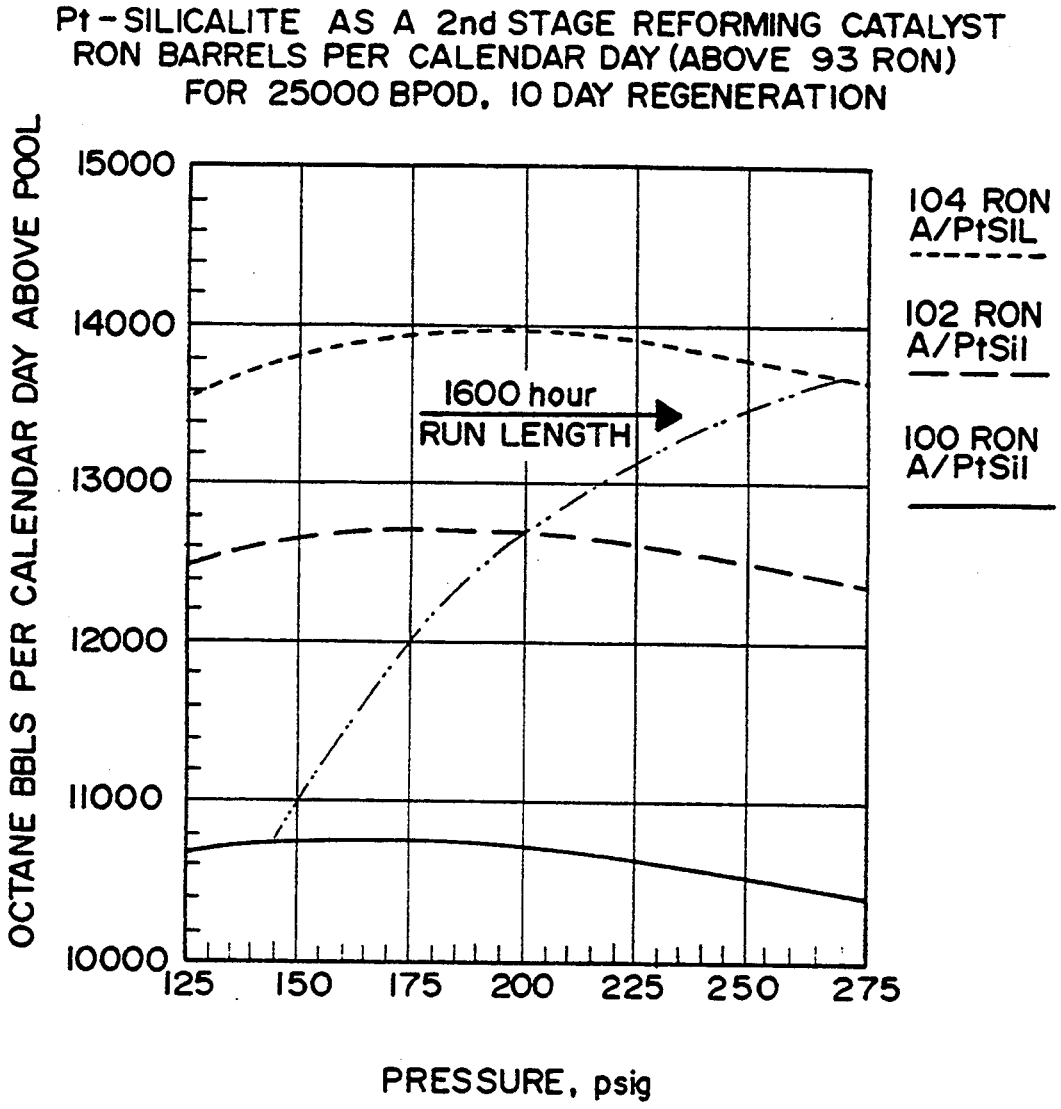
FIG. 3A illustrates, graphically OB/CD above a 93 RON pool as a function of pressure at three different product RON values using a conventional platinum/rhenium/alumina first stage catalyst followed by a platinum/silicalite second stage catalyst.
Figure 3B:
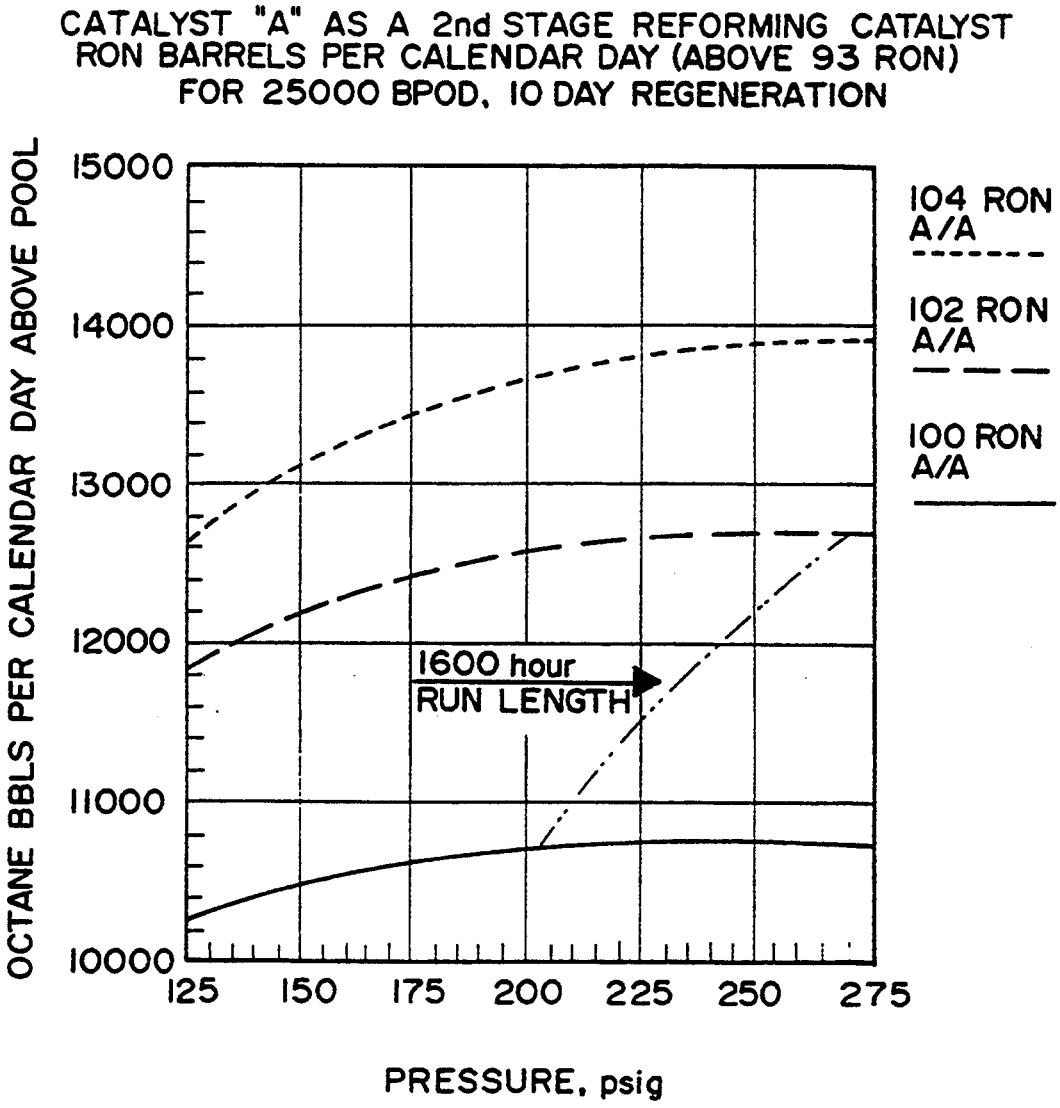
FIG. 3B illustrates, graphically OB/CD above a 93 RON pool as a function of pressure at three different product RON values using a conventional platinum/rhenium/alumina catalyst in both a first and a second stage.

With information derived as set forth above in hand one can then calculate OB/CD as a function of pressure for a situation where the lives in the penultimate and final stages are substantially equal. Basically the equation set forth above is utilized to prepare the required graphs which are shown in FIGS. 3A and 3B and which illustrate the situation where both stages are operated at the same pressure. FIG. 3B illustrates the situation where the penultimate and the final stage catalysts are both commercial platinum/rhenium/alumina catalysts. FIG. 3A illustrates the present invention where the final stage catalyst has been changed to platinum/silicalite.

In order to obtain optimum OB/CD production of product of a selected RON one then examines the graph of OB/CD against pressure. One then chooses to operate with a single selected operating pressure in both the penultimate and final stages within about 30%, more preferably 15%, of that which would give the highest overall OB/CD. As a practical matter the OB/CD versus pressure curves are flat whereby optimum OB/CD production of product reformate of the desired RON can be obtained even when the operating pressure is within ±30% of that which gives maximum OB/CD.

In accordance with the present invention both stages are operated at the same pressure. In such an instance the OB/CD is optimized subject to the condition that the pressures in each stage be substantially the same. This is the situation illustrated in FIGS. 3A and 3B.

In FIGS. 3A and 3B a constant run length line is drawn corresponding to a run length of 1600 hours between regenerations. Such a constraint can be utilized in the optimum OB/CD mode in which instance the RON of the product will be determined by following this run length line. For example, if the operation of FIG. 3A must produce a final product having an 104 RON product (with a correspondingly high aromatics content) over the run length indicated, and the penultimate stage catalyst is platinum/rhenium/alumina and the final stage catalyst is platinum/silicalite (labelled "PtSIL"), a pressure of within 30%, more preferably 15%, of 270 psig will be chosen. This follows since 270 psig gives the maximum usable OB/CD subject to the constraint that the run length between regenerations fall on the constant run length line. This is the case even though for true maximum OB/CD (with a shorter run length) the chosen pressure would have been about 195 psig.

If one elects to select final product RON as the determining constraint, one would, with the same catalyst choices, choose to operate at within 30%, more preferably 15% of 195 psig.

Note that at times both constraints can be satisfied. For example, operating at a pressure which is in the range defined by both 200±60 psig and 175±52 psig would allow satisfaction of both criteria if the criterion is 100 RON (which gives maximum OB/CD at about 175 psig) and the constant run length line is as shown in FIG. 3B which crosses the 100 RON line at about 200 psig. Similarly, at 104 RON the pressure can be chosen to be between 189 psig (30% below 270 psig) and 253 psig (30% above 195 psig), thereby satisfying both constraints.

In accordance with the present invention one selects a single pressure to use in both the penultimate stage and in the final stage thereby allowing both stages to be run without intermediate separation and without any change in pressure. However, both stages will generally be operated under other than optimum $C_5+$ liquid yield conditions.

The above process is particularly useful when it is desired to have a product having a relatively high RON (and a correspondingly high aromatics content), for example at least 100, more preferably at least about 101 and still more preferably at least about 102.

It should be noted that optimum OB/CD (and thereby the optimum AB/CD) can be obtained even when the same catalyst is used in the penultimate stage as is used in the final stage. The curves in FIG. 3B show the situation wherein a platinum-rhenium catalyst on alumina is utilized in each stage and wherein the pressure in each stage is varied from 125 to 275 psig. However, as pointed out above, it is often advantageous to use a different catalyst in the final stage than is used in the penultimate stage. The curves in FIG. 3A show utilizing platinum-rhenium-alumina catalyst in the penultimate stage and the preferred silicalite catalyst in the final stage, with both stages being run at a pressure of between 125 and 275 psig.

Figure 4:
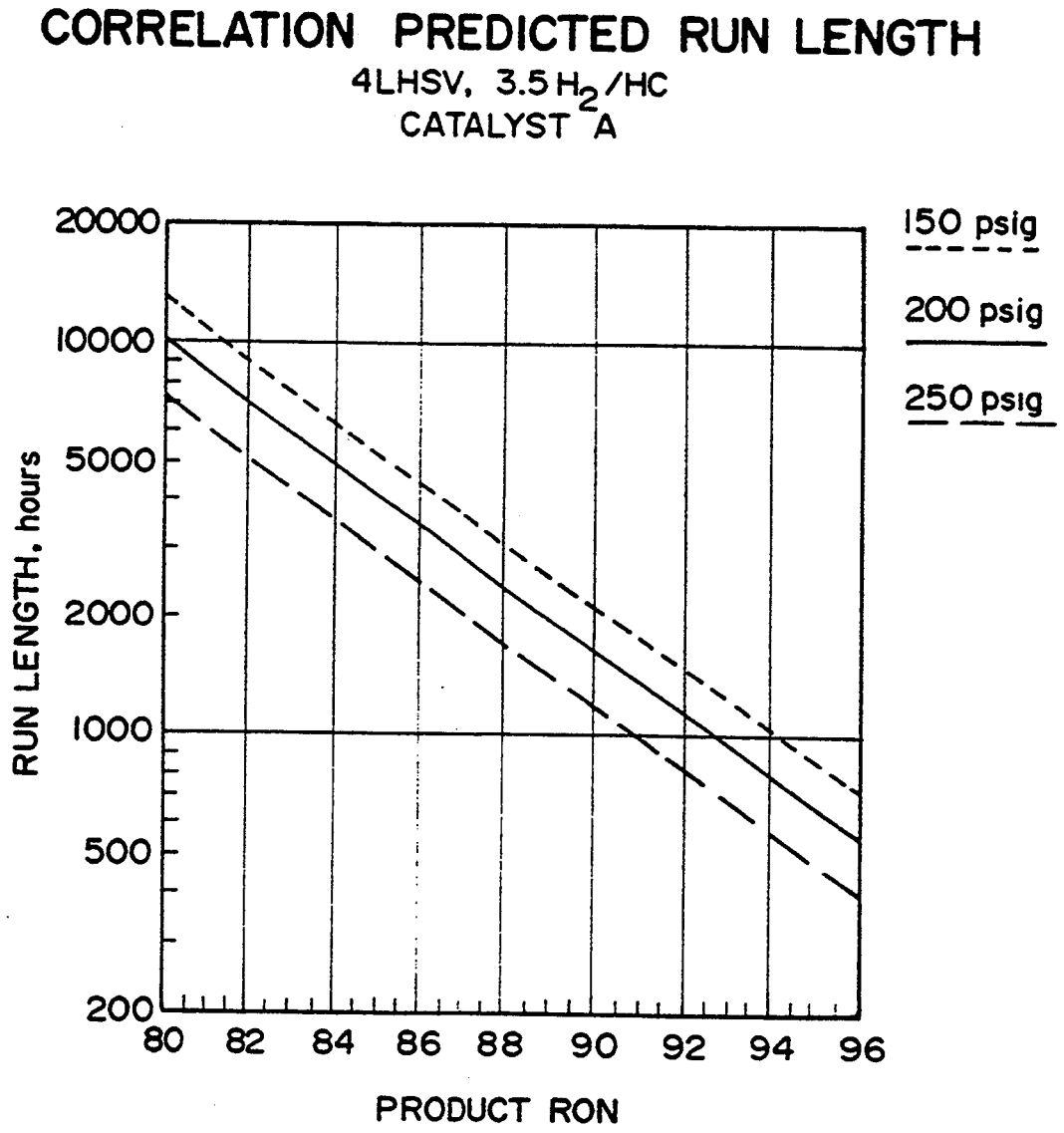
FIG. 4 illustrates, graphically the relationship between run length and product RON for a hydrobate feed using a conventional platinum/rhenium/alumina catalyst at three different pressures.

FIG. 4 illustrates data on run length as a function of penultimate stage effluent RON on a hydrobate feed of approximately 42 RON at pressures of 150, 200 and 250 psig.

Figure 5:
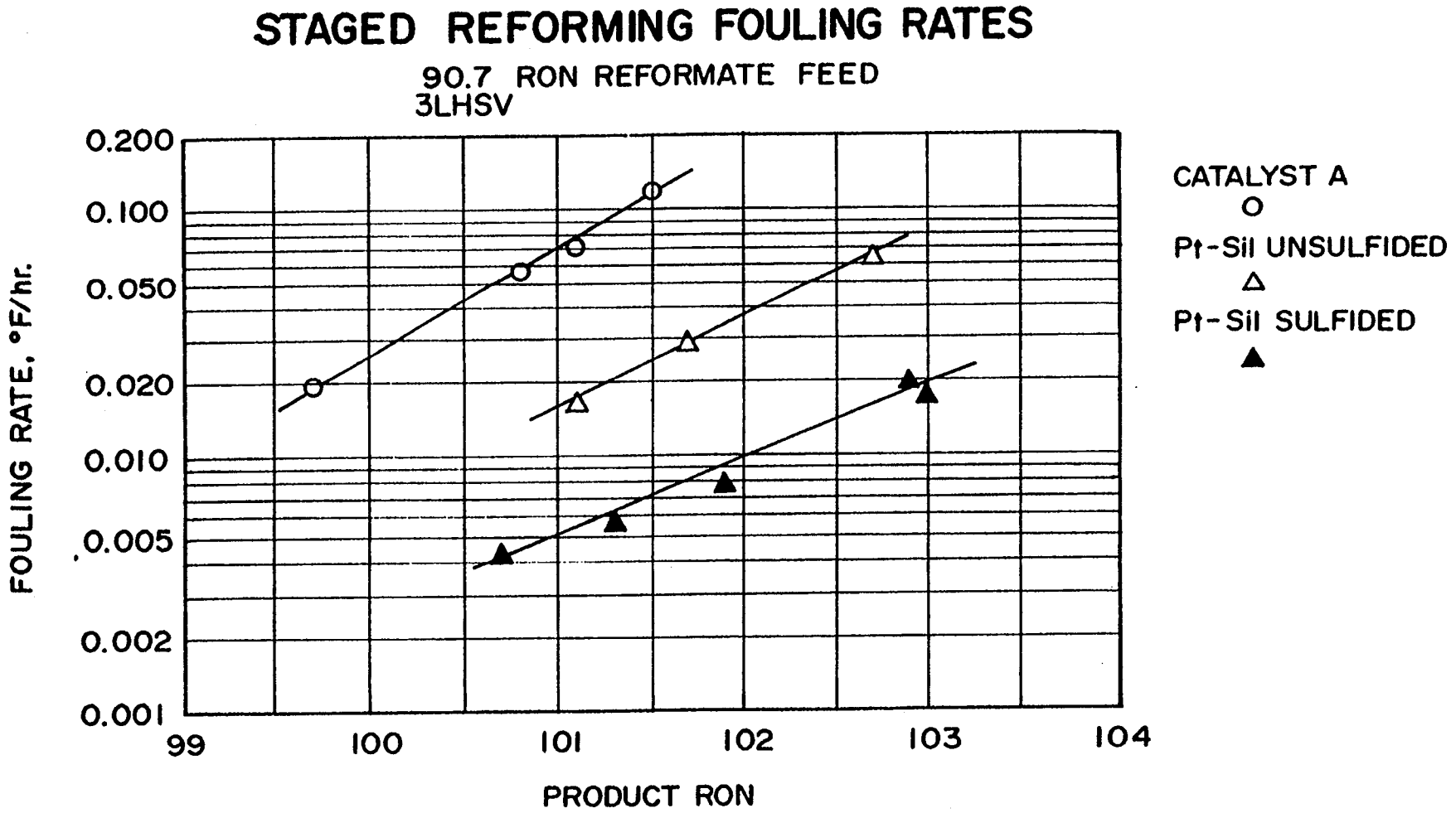
FIG. 5 illustrates, graphically the relationship between fouling rate and product RON for a 90.7 RON feed for a conventional platinum/rhenium/alumina catalyst and for both a sulfided and an unsulfided platinum/silicalite catalyst to produce a 100 RON final product.

FIG. 5 illustrates data on fouling rate for various final stage catalysts as a function of final product RON for a given penultimate stage effluent benzene content. This data can be used to estimate life between regenerations (run length) by dividing the available operating temperature span of the final stage during the run by the fouling rate. To maximize the run length, the RON of the penultimate stage effluent is chosen to make the run lengths of the penultimate and final stages equal.

Figure 6:
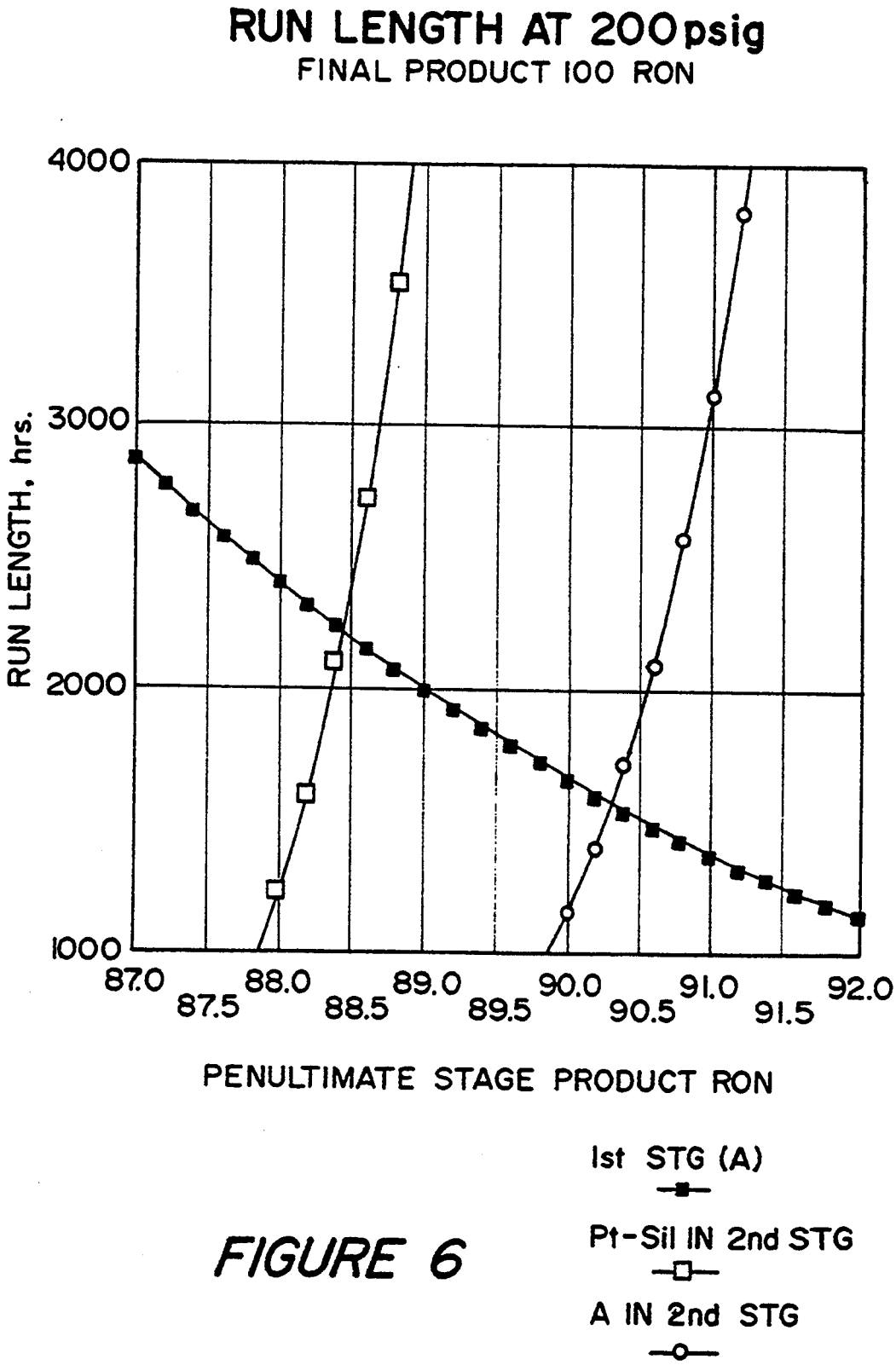
FIG. 6 illustrates, graphically the relationship between run length and penultimate stage product RON for a platinum/rhenium/alumina penultimate stage catalyst and for final stage platinum/rhenium/alumina and platinum/silicalite catalysts.

FIG. 6 shows the run length lines for both platinum/rhenium/alumina and platinum/silicalite final stage catalysts as well as the run length line for a platinum/rhenium/alumina penultimate stage catalyst. It will be noted that the run length lines cross at the points where penultimate stage and final stage run lengths are equal to one another. Thus, the method of the present invention leads to the RON of the penultimate stage effluent and the pressure being selected to optimize OB/CD, and thereby AB/CD, production.

Figure 7:
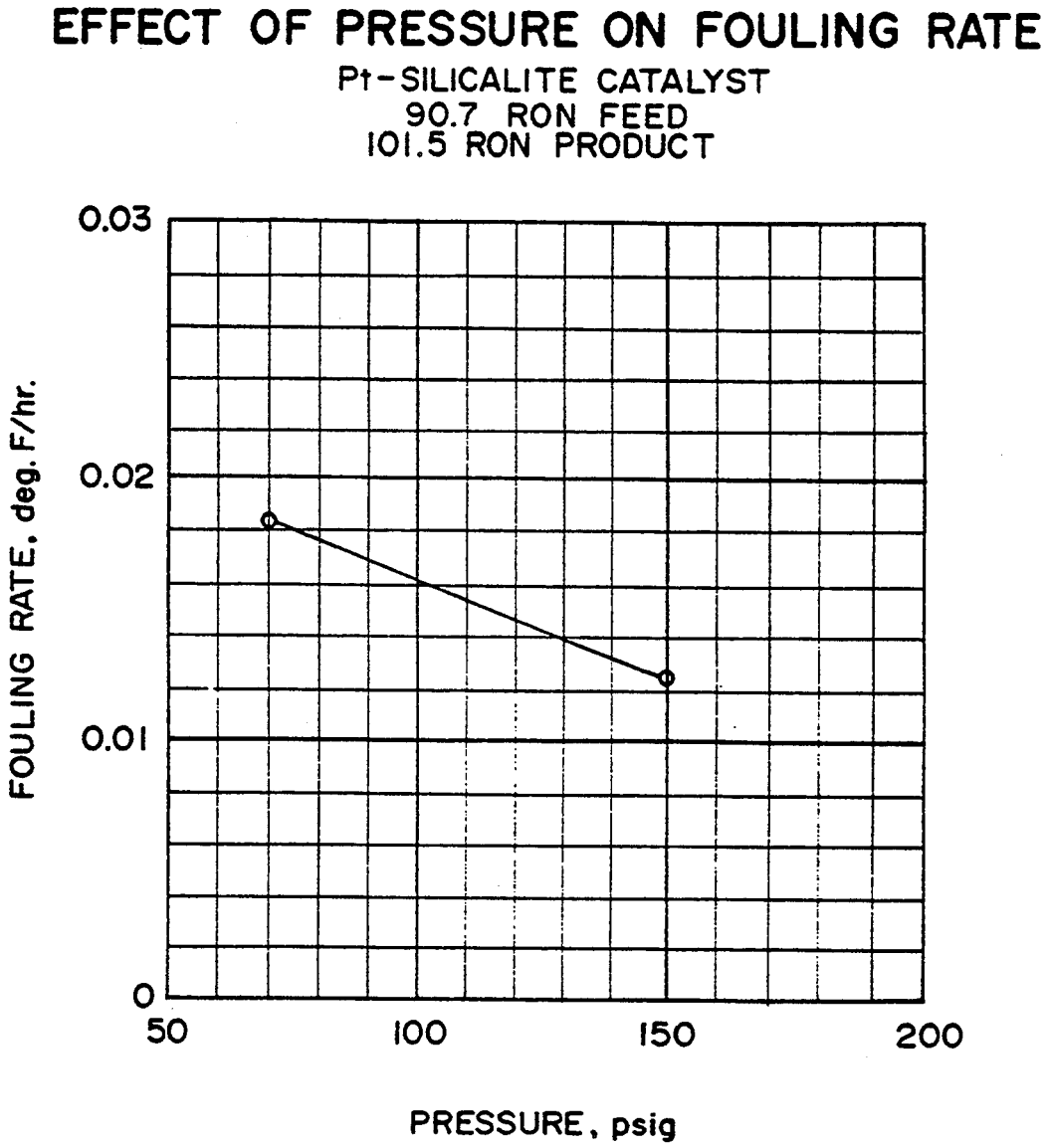
FIG. 7 illustrates, graphically the relationship between fouling rate and reforming pressure for a platinum/silicalite catalyst using a 90.7 RON feed to obtain a 101.5 RON product.
Figure 8:
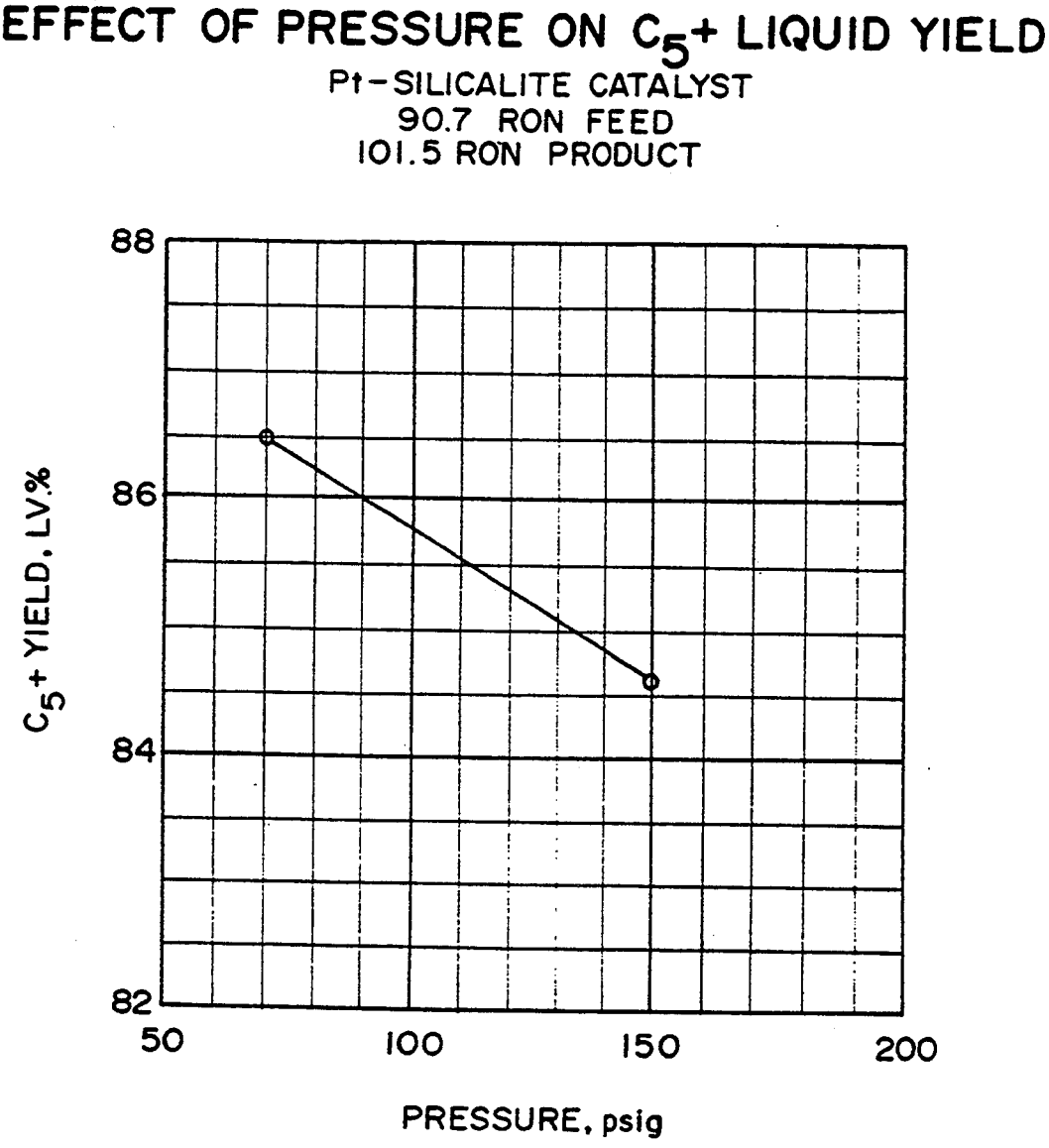
FIG. 8 illustrates, graphically the relationship between $C_5+$ liquid volume yield and reforming pressure for a platinum/silicalite catalyst using a 90.7 RON feed to obtain a 101.5 RON product.

FIGS. 7 and 8 show the effect of pressure on fouling rate and on $C_5+$ liquid volume yield, respectively, when processing a 90.7 RON feed to produce a final product having a 101.5 RON product.

Figure 9:
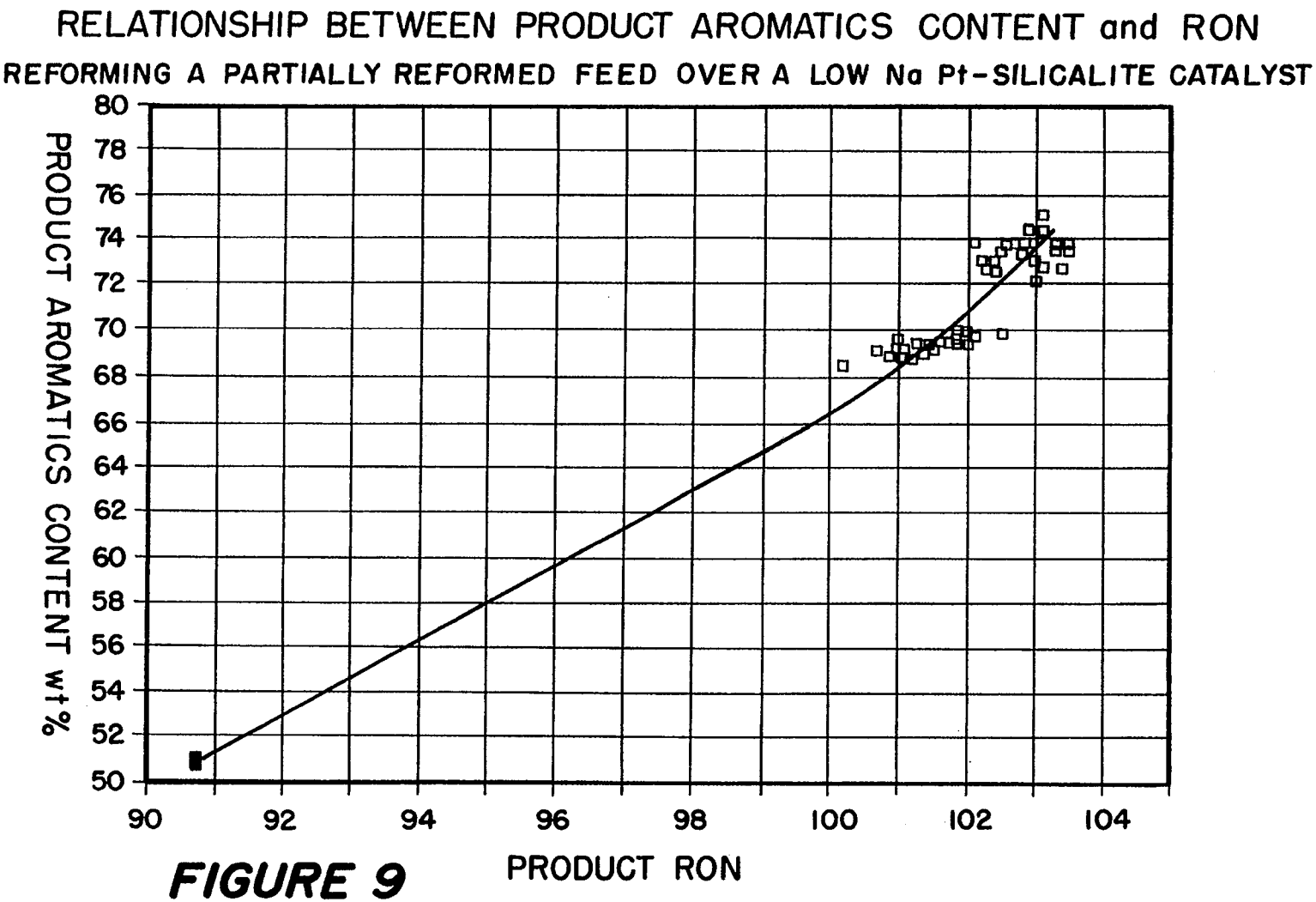
FIG. 9 illustrates, graphically, the relationship between aromatics content and product RON for a low sodium content platinum/silicalite catalyst on a partially reformed feed.

FIG. 9 shows that AB/CD is optimized along with OB/CD when one controls the process as set forth above. Thus, if one obtains optimum OB/CD one also obtains optimum AB/CD.

Examples which are set forth below illustrate the experimental procedures which were carried out to obtain the data represented in FIGS. 1–9.

EXAMPLE 1

A fifty cc charge of a commercial chlorided platinum/rhenium/alumina catalyst (0.3 wt. % Pt, 0.6 wt. % Re, 0.9 wt. % chloride) was loaded into a one inch diameter reactor and used to upgrade the benzene content of a partially reformed feed with the properties listed in Table I. The conditions used for the test were 200 psig, 3 LHSV and 3.5 $H_2$/HC ratio. A range of temperatures between 900 and 1010° F. were used in order to obtain products covering an RON range of about 98 to 101.5 and having benzene contents from 1.5 LV % (liquid volume percent) to 2.2 LV %. A second batch of similar catalyst was charged to a similar reactor and run at the same conditions, except that the run was started at about 940° F. and the temperature was slowly increased in order to hold product octane constant at about 101.5 RON as the catalyst aged. During these runs the $C_5+$ liquid yield was measured. The results of these measurements are plotted in FIG. 2A as a function of final reformate octane (and are indicative also of final reformate benzene content). These data are the basis for determining $C_5+$ liquid yields from a conventional catalyst in the final stage operating at 200 psig as a function of the increase in product octane (and thereby of benzene content) in the final stage.

TABLE I

| Properties of 90.7 RON Reformate | |
|---|---|
| API Gravity | 49.9 |
| N, ppm | 0.12 |
| S, ppm | 0.75 |
| RON | 90.7 |
| MON | 82.4 |
| Paraffins, LV % | 44.4 |
| Naphthenes, LV % | 4.6 |
| Aromatics, LV % | 51.0 |
| Distillation, | |
| ST | 108° F. |
| 10% | 176° F. |
| 30% | 229° F. |
| 50% | 263° F. |
| 70% | 290° F. |
| 90% | 321° F. |
| EP | 377° F. |

EXAMPLE 2

A fifty cc charge of a Pt-silicate catalyst prepared according to the procedure set forth in Example 7 was loaded into a one inch diameter reactor and used to upgrade the partially reformed feed having the properties listed in Table I. A guard bed (containing a platinum/chloride/alumina catalyst followed by a potassium/alumina sulfur sorbent) was installed upstream of the reactor in order to prevent sulfur from contacting the catalyst. The conditions used in the test were 60 psig, 1.5 LHSV and 1 $H_2$/HC. A range of temperatures between about 850° and 960° F. were used in order to obtain products covering an RON range of about 101 to 103 and a benzene content of 7.9 LV % to 12.5 LV %. A second batch of a similar catalyst, prepared according to the procedure of Example 9 was charged to a similar reactor and run at the same conditions except that the run was started at about 860° F. and the temperature was slowly increased to hold product octane constant at about 101.5 RON and product benzene content constant at 6.6 LV % as the catalyst aged. During these runs the $C_5+$ liquid volume yield was measured and the results of these measurements are plotted in FIG. 2B as a function of product octane. These data are the basis for determining yield from a sulfur sensitive Pt-silicalite catalyst operated at 60 psig in the final stage of an operation as a function of the increase in product octane (and thereby in benzene content) in that stage.

EXAMPLE 3

A fifty cc charge of a Pt-silicalite catalyst prepared according to the procedures given in Example 6 was loaded into a one inch reactor, sulfided by exposure to feed containing about 40 ppm by volume sulfur in the form of dimethyldisulfide until $H_2S$ breakthrough was observed and used to upgrade the partially reformed feed described in Table I. The test conditions were 70 psig, 3 LHSV and 1 H2/HC. A range of temperatures from about 860° to 1010° F. was used in order to obtain products covering an octane range of about 101–103 RON and benzene contents of 3.5 LV % to 6.0 LV %. During these runs the $C_5+$ liquid volume yield was measured and the results are plotted in FIG. 2B as a function of final product octane. These data are the basis for determining yield from a sulfur tolerant Pt-silicalite catalyst operating at 70 psig in the final stage of a process as a function of the increase in product octane (and thereby of % benzene content) in that stage.

EXAMPLE 4

A fifty cc charge of a Pt-silicalite catalyst prepared according to the procedures given in Example 8 was loaded into a one inch diameter reactor, sulfided as described in Example 3, and used to upgrade the partially reformed feed described in Table I. The conditions used for the test were 70 psig, 3 LHSV and 1 $H_2$/HC ratio. A range of temperatures between about 910° and 980° F. was used in order to obtain products covering a range of about 99–102 RON and benzene contents of 2.5 LV % to 3.9 LV %. During these runs the $C_5+$ liquid volume yield was measured and the results of these measurements are plotted in FIG. 2B as a function of final product octane (and thereby of benzene percent). These data are the basis for determining liquid volume $C_5+$ yield from a second sulfur tolerant Pt-silicalite catalyst operating at 70 psig in the final stage of processing as a function of the increase in product octane and benzene content in that stage.

EXAMPLE 5

As is known in the art, experience with the use of catalyst "A" and similar conventional reforming catalysts over a number of years can be expressed in the form of a statistical correlation relating product properties to the properties of the feed and to process conditions. That correlation was used to predict the $C_5+$ liquid volume yield that would be obtained from the use of a conventional chlorided platinum/rhenium/alumina catalyst to convert a feed with the properties shown in Table II. The results of these predictions are shown in FIG. 1 which shows the yield that would be obtained upon subjecting that feed to conversion in a first stage to obtain product octanes in the 80 to 96 RON range.

TABLE II

| Properties of Hydrobate | |
|---|---|
| API Gravity | 60.6 |
| N, ppm | 0.1 |
| S, ppm | 0.05 |
| RON | 42.9 |
| Paraffins, LV % | 63.6 |
| Naphthenes, LV % | 27.3 |
| Aromatics, LV % | 9.1 |
| Distillation | |
| ST | 173° F. |
| 10% | 210° F. |
| 30% | 226° F. |
| 50% | 242° F. |
| 70% | 269° F. |
| 90% | 316° F. |
| EP | 378° F. |

EXAMPLE 6

A Pt-impregnated silicalite catalyst was made as follows: 80 g of $NaNO_3$ and 8.3 g of $H_3BO_3$ were dissolved in 80 g of distilled water. To this was added 1000 g of a 25% aqueous solution of tetrapropylammonium hydroxide (TPA-OH) and an additional 800 g of distilled water. This was mixed with rapid stirring for 10 minutes. 200 g of Cab-O-Sil grade M-5 silica was added with rapid stirring and mixed an additional 10 minutes. The pH of the mixture was 12.8. The composition of the mixture, expressed in molar ratio of oxides, was:

$(TPA)_2O:0.76\ Na_2O:0.11\ B_2O_3:5.42\ SiO_2:147\ H_2O.$

The mixture was then poured into a Teflon bottle and kept at 90° C. for seven days. The product was filtered, dried overnight at 110° C. in a vacuum oven, and then calcined for 8 hours at 538° C. The percent silicalite was 100% as determined by X-ray diffraction analysis. The calcined sieve had a $SiO_2/Al_2O_3$ molar ratio of about 5000. The sieve contained 1.6 wt. % Na and 0.24 wt. % B.

The sieve, which had an average crystallite size of about 0.4 microns in diameter (roughly spherical), was then impregnated with 0.8 wt. % Pt by the pore-fill method using an aqueous solution of $Pt(NH_3)_4(NO_3)_2$. The catalyst was then dried overnight in a vacuum oven at 110° C. and calcined in dry air for 4 hours at 204° C., 4 hours at 260° C., and 4 hours at 288° C.

The calcined catalyst was exchanged twice with a 25% aqueous solution of ammonium acetate at 82° C. The catalyst was then dried overnight in a vacuum oven at 110° C., and calcined in dry air for 4 hours at 177° C., 4 hours at 232° C., and 4 hours at 260° C. The final catalyst contained 0.22 wt. % B and 92 ppm Na, as measured by atomic spectroscopy using an inductively coupled plasma detection technique.

EXAMPLE 7

Another Pt-impregnated silicalite catalyst was made as follows: 18.4 g of $NaNO_3$ and 40 g of EDTA were dissolved in 80 g of distilled water. To this was added 800 g of a 25% aqueous solution of TPA-OH and mixed for 15 minutes. Then 640 g of Ludox AS-30 were added with rapid stirring and mixed for an additional 15 minutes. The pH of the mixture was 13.2. The composition of the mixture (excluding the EDTA), expressed in molar ratio of oxides, was:

$(TPA)_2O:0.22\ Na_2O:6.50\ Sio_2:125\ H_2O.$

The mixture was then poured into a Teflon bottle and kept at 100° C. for seven days. The product was filtered, dried overnight at 110° C. in a vacuum oven, and then calcined for 8 hours at 538° C. The percent silicalite was 100% as determined by XRD analysis. The calcined sieve had an average crystallite size of about 0.3 micron, and contained 780 ppm Al (1100 molar $SiO_2/Al_2O_3$) and 2.1% Na.

The sieve was then impregnated with 0.8 wt. % Pt by the pore-fill method using an aqueous solution of $Pt(NH_3)_4(NO_3)_2$. The catalyst was then dried overnight in a vacuum oven at 110° C. and calcined in dry air at 427° C. for 8 hours.

EXAMPLE 8

Another Pt-impregnated silicalite catalyst was made as follows: 1 g of $NaNO_3$ was dissolved in 20 g of distilled water. To this was added 288 g of a 20% aqueous solution of TPA-OH with mixing. Then 166 g of Ludox AS-30 were added with rapid stirring and mixed for 10 minutes. The pH of the mixture was 13.2. The composition of the mixture, expressed in molar ratio of oxides, was:

$(TPA)_2O:0.051\ Na_2O:7.09\ SiO_2:174\ H_2O.$

The mixture was then poured into a Teflon bottle and kept at 100° C. for seven days. The product was filtered, dried overnight at 110° C. in a vacuum oven, and calcined for 8 hours at 538° C. The percent silicalite was 100% as determined by XRD analysis. The calcined sieve had an average crystallite size of about 0.3 micron, and contained 800 ppm Al (1100 molar $SiO_2/Al_2O_3$) and 0.39 wt. % Na.

The sieve was impregnated with 0.3 wt. % Na and then impregnated with 0.8 wt. % Pt, dried, and calcined as in Example 6. Following calcination of the Pt-impregnated sieve, the catalyst was impregnated with an additional 0.07 wt. % Na to bring the total Na to 0.38 wt. %, dried for 8 hours in a vacuum oven at 120° C., then calcined in dry air at 149° C. for 2 hours, 204° C. for 2 hours, and 260° C. for 4 hours.

EXAMPLE 9

A Pt-impregnated silicalite catalyst was made as follows: 11.5 g $NaNO_3$ were dissolved in 50 g of distilled water. To this was added 500 g of a 25% aqueous solution of TPA-OH and mixed with rapid stirring for 10 minutes. 5 g of $H_3BO_3$ were added and mixed. Then 400 g of Ludox AS-30 (30% silica) were added with rapid stirring and mixed for 15 minutes. The pH of the mixture was 13.2. The composition of the mixture, expressed in molar ratio of oxides, was:

$(TPA)_2O:0.22\ Na_2O:0.13\ B_2O_3:6.49\ SiO_2:127\ H_2O.$

The mixture was poured into a Teflon bottle and kept at 90° C. for five days. The product was filtered, dried overnight at 110° C. in a vacuum oven, and then calcined for 8 hours at 538° C. The percent silicalite was 100% as measured by XRD analysis. The resulting calcined sieve had an average crystallite size of about 0.3 micron, and contained 0.96 wt. % Na, 0.19 wt. % B, and 800 ppm Al (1100 molar $SiO_2/Al_2O_3$).

The sieve was then impregnated with 0.8 wt. % Pt, dried, and calcined as in Example 7. The use of this catalyst is reported in Example 2.

EXAMPLE 10

The graph shown in FIG. 9 was obtained by reforming a feed having an RON of about 90.7 and being constituted as follows:

Composition:

| | |
|---|---|
| Paraffins, LV % | 44.4 |
| Naphthenes, LV % | 4.6 |
| Aromatics, LV % | 51.0 |

Distillation Curve, D86:

| | |
|---|---|
| Start, ° F. | 108 |
| 10%, °F. | 176 |
| 30%, °F. | 229 |
| 50%, °F. | 263 |
| 70%, °F. | 290 |
| 90%, °F. | 321 |
| End, °F. | 377 |

to produce product reformates of differing RON values and measuring the total aromatics content of the product.

In accordance with the invention, the penultimate stage and the final stage can be operated at the same pressure. In this manner the need for an additional separator and recycle compressor is eliminated. There is no need for any intermediate separation, pressurization or depressurization stages. As a result of operating the two stages at the same pressure usually neither stage will be operating under its maximum LV % $C_5$+ yield conditions. Thus, there is somewhat of a trade off in choosing to operate both the final stage and the stage preceding it at the same pressure. Surprisingly, it is still economically attractive to operate in this mode in spite of the loss in $C_5$+ liquid volume yield.

As previously stated, the final stage can utilize a catalyst which is particularly good for a subset of the reactions of dehydrocyclization, isomerization and dehydrogenation while the earlier stage can utilize a catalyst or catalysts which are particularly good for the remainder of the reactions. It is known that some catalysts are particularly good at isomerization and dehydrogenation but may not be as good as others at dehydrocyclization. Other catalysts are particularly good at dehydrocyclization. The most commonly used reforming catalyst today comprises a Group VIII metal, normally platinum, and a porous inorganic oxide support such as alumina which has been chlorided. Such a catalyst is particularly good for isomerization and dehydrogenation reaction and is also effective for dehydrocyclization. Furthermore, such a catalyst is usable with feeds which contain significant amounts of sulfur over relatively long periods of time. Catalysts of this nature, as discussed above, often also include one or more promoter metals such as rhenium or tin. Due at least partially to chloriding, such catalysts have a tendency to cause some hydrocracking with resulting $C_4$-production.

While a catalyst of the nature described above does a good overall general job of reforming there are some catalysts which are more effective for dehydrocyclization reactions of the $C_6$–$C_8$ components of the feed and/or cause less hydrocracking. Thus, one can desirably use a catalyst in the final stage which is superior for dehydrocyclization and which causes little hydrocracking following use in an earlier reforming stage of a catalyst as previously described. The result then is a significant upgrading in the octane and in the aromatics content in the product exiting the final stage.

The catalyst in the final stage is preferably resistant to sulfur so that it can receive the feed directly from the penultimate reforming stage without any intermediate separation or sulfur absorption step. The stages are run at the same pressure but both the temperatures and space velocities can be different, the latter because the amount of catalyst can be different in each of the stages.

After the desired metal or metals have been introduced, the catalyst is preferably treated in air, or air diluted with an inert gas, then reduced in hydrogen. Catalysts containing platinum are typically subjected to halogen or halide treatments to achieve or maintain a uniform metal dispersion. Typically, the halide is a chloride compound. The recommended final stage catalysts can be subjected to similar treatments although the preferred catalyst does not contain chloride in the final form so as to reduce undesirable hydrocracking reactions. For example, steam stripping may be used to reduce the chloride content.

The catalysts can be employed in any of the conventional types of catalytic reforming and/or aromatization equipment. The catalysts can be employed in the form of pills, beads, pellets, granules, broken fragments, or various special shapes within a reaction zone.

The feed to the first reformer in a series of reforming or dehydrogenation stages can be a light hydrocarbon or naphtha fraction, boiling within the range of about 70° to 550° F. and preferably from 120° to 400° F. This can include, for example, straight run naphthas, paraffinic raffinates from aromatic extraction, and $C_6$–$C_{10}$ paraffin-rich feeds, as well as paraffin-containing naphtha products from other refinery processes, such as hydrocracking or previous reforming steps. The actual processing conditions will depend in large measure on the feed used, whether highly aromatic, paraffinic or naphthenic and upon the desired octane rating and aromatic content of the product of the penultimate stage as determined in accordance with the present invention. The preferred feed will contain a considerable fraction of hydrocarbons which can be aromatized to benzene by dehydrogenation and/or dehydrocyclization. Thus, the preferred feed to the penultimate stage will contain at least about 2%, more preferably at least about 10%, still more preferably at least about 20% of $C_6$ normal- or slightly branched chain- or cyclo- paraffins.

The final stage catalyst is preferably used to dehydrocyclize acyclic hydrocarbons to form aromatics with minimal hydrocracking to form $C_4$- products. The feed to the final stage is the effluent from the penultimate stage.

In accordance with one embodiment of the present invention, the pressure in each stage is the same and is preferably between 30 psig and 350 psig, more preferably between 50 psig and 300 psig, and most preferably between 100 psig and 250 psig. The liquid hourly space velocity (LHSV) in the penultimate stage is preferably between about 0.1 to about 10 $hr.^{-1}$ with a value in the range of about 0.3 to about 5 $hr.^{-1}$ being preferred. In the final stage the LHSV is preferably in the range from about 0.1 to about 20 $hr^{-1}$ with a value in the range of about 0.1 to about 15 being preferred and of about 0.3 to about 10 $hr.^{-1}$ being more preferred. The temperature in the penultimate stage is preferably between about 600° F. and about 1100° F., more preferably between 640° F. and 1050° F. In the final stage the temperature is preferably between about 600° F. and about 1100° F., more preferably between 750° F. and about 1050° F. Heaters can be provided to assure that the desired temperatures are present in each stage. This is generally needed because of the overall endothermicity of the reactions. As is well known to those skilled in the art, the initial selection of the temperature within this broad range is made primarily as a function of the desired conversion level of the acyclic hydrocarbon considering the characteristics of the feed and of the catalyst. Thereafter, to provide a relatively constant value for conversion, the temperature is slowly increased during the run to compensate for the inevitable deactivation (catalyst fouling) that occurs.

The preferred low alkali catalysts as described herein achieve particularly good selectivity to $C_5$+ liquids in reforming or dehydrocyclization if they are presulfided prior to use. The sulfiding of the catalyst can be carried out in situ (in the reactor or reactors) or ex situ. Preferably, the sulfiding is carried out in situ. Sulfiding techniques known in the art are suitable.

In the process, the hydrocarbon feed is contacted with the catalyst in the penultimate stage and then with the catalyst in the final stage under aromatization conditions. This contacting can be accomplished by using the catalyst in a fixed-bed system, a moving bed system, a fluidized system or in a batch-type operation; however, it is preferred to use either a fixed-bed system or a dense phase moving bed system.

In a fixed-bed system, typically the hydrocarbon feed is preheated to the desired reaction temperature and then passes into a stage containing a fixed-bed of the catalyst. It is well known that aromatization is typically carried out in a series of reactors or train of reactors. According to the present invention, the preferred catalyst is disposed in the last or final stage reactor(s) of a unit which comprises a series of reactors. Thus, the catalyst may be disposed in the last reactor(s) of a series of three or four reactors, with other catalyst, such as conventional reforming catalyst, being located in the first reactor (or in the first two or three reactors).

The feed hydrocarbons to the processing reaction zone may be contacted with the catalyst in either upward, downward or radial flow fashion. In addition, the hydrocarbon may be in liquid phase or in mixed liquid-vapor phase or vapor phase when it contacts the catalyst, with best results usually being obtained in vapor phase.

A particularly preferred catalyst for the final stage is described in co-pending application Ser. No. 488,156, filed Mar. 2, 1990, and incorporated in its entirety by reference. This catalyst is useful for catalytic reforming of feed hydrocarbons in a reaction zone which may be subjected to periodic exposure to more than 100 ppm sulfur in a process which comprises contacting the feed under catalytic reforming conditions with a catalyst comprising a noble metal, an intermediate pore size crystalline silicate having a silica to alumina ratio of at least 200, preferably at least 500, and a low alkali content, preferably less than 5,000 ppm.

For the catalyst used in final stage, it is advantageous to use a small crystallite size intermediate pore size crystalline silicate of high silica to alumina ratio. Small crystalline size for this component of the catalyst is discussed in more detail in copending patent application Ser. No. 97,789, refiled Aug. 22, 1989 as Ser. No. 396,816, and entitled "A Crystalline Silicate Catalyst and A Reforming Process Using the Catalyst". The disclosure of Ser. No. 396,816 is incorporated herein by reference, particularly its disclosure with regard to small crystallite size intermediate pore size crystalline silicates and methods of making such crystallites. Preferred small crystallite sizes for the present invention are less than 10 microns, more preferably less than 5 microns, still more preferably less than 2 microns, and especially preferred less than 1 micron. The size is on a basis of the largest dimension of the crystallites. Preferred shapes for the crystallites are approximately spherical. When a crystallite size is specified, preferably at least 70 wt. % of the crystallite are within the specified range, more preferably at least 80 wt. %, and most preferably at least 90 wt. %.

Thus, according to a preferred embodiment of the present invention, the catalyst used in the final stage of a multistage aromatization process comprises an intermediate pore size crystalline silicate of small crystallite size and having a high silica to alumina ratio and having a low alkali content. According to a particularly preferred embodiment, the catalyst is presulfided or is sulfided during operations.

The crystalline silicate component of the catalyst of the present invention is generally referred to herein as silicate or crystalline silicate, but also is commonly referred to as a zeolite.

The term "alkali" is used herein to mean Group IA metals. Preferred alkali metals for use in the catalyst of the final stage are sodium, potassium, cesium, lithium and rubidium. Sodium and potassium are more preferred. Sodium is the most preferred alkali metal for use in the catalyst.

The amount of alkali must be low, lower than the levels typically taught in the prior art for "non-acidic" catalyst. The amount of alkali will vary depending on the ratio of silica to alumina in the crystalline silicalite component of the catalyst, with less alkali being required as the silica to alumina ratio of the silicalite increases. Preferred amounts of alkali for the catalyst where the silica to alumina ratio is 500:1 or greater are less than 5000 ppm, more preferably less than 2500 ppm, and most preferably less than 1500 ppm.

Preferred amounts of the alkali for the catalyst where the silica to alumina ratio is 1000:1 or greater, are less than 2500 ppm, more preferably less than 1500 ppm, and most preferably less than 1000 ppm.

Amounts of alkali are by weight based on the total weight of the crystalline silicate component of the catalyst. The abbreviation ppm indicates part per million.

The amount of alkali is an amount sufficient to neutralize substantially all of the acidity of the crystalline silicate. Preferred amounts of alkali are between one and five parts alkali to one part aluminum, on a molar basis, based on the aluminum in the crystalline silicate. Thus, the amount of alkali will vary as a function of aluminum. Typically preferred lower amounts of alkali are 0.01, more typically 0.1 wt. %. In most cases, some alkali is present in the crystalline silicate that cannot be ion exchanged out of the silicate on a practical basis. This "locked-in" alkali can be minimized by selecting appropriate methods of preparing the silicate. Locked in alkali is not effective and is therefore not counted as part of the preferred amount of alkali. If any binder is used it also should be neutralized if it has any acid sites.

The silicate of the catalyst of the preferred final stage catalyst preferably is low in acidity, more preferably substantially free of acidity. However, the low acidity silicate, or silicate substantially free of acidity, is, not achieved by using large amounts of alkali. The low acidity, or substantial non-acidity, may be achieved by a combination of low aluminum content in the silicate and the use of low amounts of alkali and/or the use of alkaline earth metals. The silicate component of the catalyst preferably is included in a matrix or binder to form the finished catalyst, as described hereinbelow. Preferably, the finished catalyst is of low acidity, more preferably substantially free of acidity.

The acidity of the crystalline silicate or of the finished catalyst may be determined as follows: 0.1–1.5 g of silicate (or catalyst) is mixed with 1 g of acid-washed and neutralized alundum and packed in a 3/16" stainless steel reactor tube with the remaining space filled with alundum. The reactor is then placed in a clam-shell furnace at 427° C. and the reactor outlet connected to the inlet of a gas chromatograph. The inlet is connected to the carrier gas line of the GC. Helium is passed through the system at 30 cc/min. 0.04 Microliter pulses of n-decane are injected through a septum above the reactor and reaction products are determined by standard GC analysis. Blank runs with alundum should show no conversion under the experimental conditions, nor should a 100% Catapal alumina catalyst.

A pseudo-first-order, cracking rate constant, k, is calculated using the formula:

$$k = \frac{1}{A} \ln \frac{1}{1 - x}$$

where A is the weight of silicate in grams and x is the fractional conversion to products boiling below decane. The silicate (or catalyst) is substantially free of acidity when the value of ink is less than about −3.8. The silicate (or catalyst) is low in acidity if ink is less than about −2.3.

As an alternative, an alkaline earth metal (Group IIA metal) is also included in the catalyst. Magnesium, calcium, strontium and barium are preferred Group IIA metals. Magnesium is a more preferred Group IIA metal for use in the preferred final stage catalyst. The alkaline earths are advantageously used to reduce the acidity of the catalyst. The alkaline earth metals are not as effective as the alkali metals in reducing acidity, but the alkaline earth metals do not impart as much sulfur sensitivity to the catalyst as do the alkali metals. In this embodiment alkaline earth metals are included in the crystalline silicate in an amount between 0.1 to 10.0, preferably 0.5 to 5.0, parts of alkaline earth metal per part alkali metal, on a molar basis.

As previously stated, sulfur tolerance is desirable in the final stage catalyst. The preferred catalyst of the present invention has a surprising resistance to sulfur poisoning or deactivation in the range of about 0.1 to 2 ppm sulfur.

When reforming or dehydrocyclizing or aromatizing using a highly sulfur sensitive crystalline silicate catalyst, it is necessary to go to substantial expense to reduce the sulfur in the feed to very low levels. Frequently, extensive guard bed and/or sulfur sorbent systems are used. Even in a situation where the sulfur content of the feed to the final stage will normally be very low, the preferred catalyst is advantageously used as it will tolerate exposure to sulfur; that is, the catalyst shows much better activity restoration upon discontinuing the exposure to high sulfur levels. Thus, when using the preferred catalyst in the final stage, the capital cost of an aromatization unit can be reduced, as less sulfur guard or sulfur removal equipment is needed to protect the final catalytic reforming or dehydrocyclization or aromatization stage as is the case with other crystalline silicate catalysts.

Although the catalyst used in the stages of an aromatization process optimized in accordance with the present invention may be sulfur tolerant, nonetheless, it is preferred not to subject the catalyst in the reforming or dehydrocyclization or aromatization stage to gross amounts of sulfur. Thus, preferably the sulfur in the feed is not above about 25 ppm, more preferably not above 10 ppm, and most preferably not above 2 ppm.

Amounts of sulfur are by weight based on the feed hydrocarbon to the process. Also, the sulfur is calculated on the basis of elemental sulfur, although the sulfur may be in the form of organic sulfur compounds or in the form of hydrogen sulfide. The abbreviations ppm and ppb indicate parts per million and parts per billion, respectively.

The feed to the final stage is the effluent from the penultimate stage. The penultimate stage effluent may be a $C_5+$ or $C_6+$ hydrocarbon fraction boiling up to 550° F., more preferably up to 400° F. It will also contain hydrogen and $C_1$–$C_4$ hydrocarbons from the penultimate step.

As previously described, the present invention contemplates the use of an intermediate pore size crystalline silicate material having a high silica to alumina ratio in its final stage. One preferred material is silicalite, a high silica to alumina ratio form of ZSM-5.

Table 1 below reports the X-ray diffraction pattern for ZSM-5 as given in the Argauer patent (U.S. Pat. No. 3,702,886).

TABLE 1

| Interplanar Spacing d(⊥) | | Relative Intensity |
|---|---|---|
| 11.1 | ± 0.2 | s. |
| 10.0 | ± 0.2 | s. |
| 7.4 | ± 0.15 | w. |
| 7.1 | ± 0.15 | w. |
| 6.3 | ± 0.1 | w. |
| 6.04 } 5.97 | ± 0.1 | w. |
| 5.56 | ± 0.1 | w. |
| 5.01 | ± 0.1 | w. |
| 4.60 | ± 0.08 | w. |
| 4.25 | ± 0.08 | w. |
| 3.85 | ± 0.07 | v.s. |
| 3.71 | ± 0.05 | s. |
| 3.04 | ± 0.03 | w. |
| 2.99 | ± 0.02 | w. |
| 2.94 | ± 0.02 | w. |

Also as reported in the Argauer patent, the values in Table 1 were determined by standard techniques. The radiation was the K-alpha doublet of copper, and a scintillation counter spectrometer with a strip chart pen recorder was used. The peak heights, I, and the positions as a function of 2 times theta, where theta is the Bragg angle, were read from the spectrometer chart. From these, the relative intensities, $100\ I/I_o$, where $I_o$ is the intensity of the strongest line or peak, and d (obs.), the interplanar spacing in ⊥, corresponding to the recorded lines, were calculated. In Table 1, the relative intensities are given in terms of the symbols s.=strong, m.=medium, m.s.=medium strong, m.w.=medium weak and v.s.=very strong. It should be understood that this X-ray diffraction pattern is characteristic of all the species of ZSM-5 compositions. Ion exchange of the sodium ion with cations reveals substantially the same pattern with some minor shifts in interplanar spacing and variation in relative intensity. Other minor variations can occur depending on the silicon to aluminum ratio of the particular sample, as well as if it had been subjected to thermal treatment.

ZSM-5 is regarded by many to embrace "silicalite" as disclosed in U.S. Pat. No. 4,061,724 to Grose et al. For ease of reference herein, silicalite is referred to as a ZSM-5-type material with a high silica to aluminum ratio and is regarded as embraced within the ZSM-5 X-ray diffraction pattern. The silica to alumina ratio is on a molar basis of silica ($SiO_2$) to alumina ($Al_2O_3$).

Various references disclosing silicalite and ZSM-5 are provided in U.S. Pat. No. 4,401,555 to Miller. These references include the aforesaid U.S. Pat. No. 4,061,724 to Grose et al.; U.S. Pat. Reissue No. 29,948 to Dwyer et al.; Flanigan et al., Nature, 271, 512–516 (Feb. 9, 1978) which discusses the physical and adsorption characteristics of silicalite; Bibby et al., Nature, 280, 664–665 (Aug. 23, 1979) which reports the preparation of a crystalline silicate called "silicalite-2" and Anderson et al., J. Catalysis 58, 114–130 (1979) which discloses catalytic reactions and sorption measurements carried out on ZSM-5 and silicalite. The disclosures of these references and U.S. Pat. No. 4,401,555 are incorporated herein by reference, particularly including their disclosures on methods of making high silica to alumina crystalline silicates having an X-ray diffraction pattern in substantial accord with Table 1.

Other crystalline silicates which can be used in the final reforming stage include those as listed in U.S. Pat. No. 4,835,336; namely: ZSM-11, ZSM-12, ZSM-22, ZSM-23, ZSM-35, ZSM-38, ZSM-48, and other similar materials.

Additionally, zeolites SSZ-20 and SSZ-23 are preferred catalysts. SSZ-20 is disclosed in U.S. Pat. No. 4,483,835, and SSZ-23 is disclosed in U.S. Pat. No. 4,859,442, both of which are incorporated herein by reference.

ZSM-5 is more particularly described in U.S. Pat. No. 3,702,886 and U.S. Pat. No. Re. 29,948, the entire contents of which are incorporated herein by reference.

ZSM-11 is more particularly described in U.S. Pat. No. 3,709,979 the entire contents of which are incorporated herein by reference.

ZSM-12 is more particularly described in U.S. Pat. No. 3,832,449, the entire contents of which are incorporated herein by reference.

ZSM-22 is more particularly described in U.S. Pat. Nos. 4,481,177, 4,556,477 and European Pat. No. 102,716, the entire contents of each being expressly incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,397,827 the entire contents of which are incorporated herein by reference.

Of these, ZSM-5, ZSM-11, ZSM-22 and ZSM-23 are preferred. ZSM-5 is more preferred for use as the catalyst of the present invention.

Intermediate pore size crystalline silica polymorphs useful in the present invention include silicalite, as disclosed in U.S. Pat. No. 4,061,724, and the "RE 29,948 organosilicates", disclosed in RE 29,948, both of which are incorporated by reference. The essentially alumina-free chromia silicate, CZM, is disclosed in Ser. No. 160,618, Miller, filed Jun. 28, 1980, incorporated by reference.

The crystalline silicate may be in the form of a borosilicate, where boron replaces at least a portion of the aluminum of the more typical aluminosilicate form of the silicate. Borosilicates are described in U.S. Pat. Nos. 4,268,420; 4,269,813; 4,327,236 to Klotz, the disclosures of which patents are incorporated herein, particularly that disclosures related to borosilicate preparation.

In the borosilicate, the preferred crystalline structure is that of ZSM-5, in terms of X-ray diffraction pattern. Boron in the ZSM-5 type borosilicates takes the place of aluminum that is present in the more typical ZSM-5 crystalline aluminosilicate structures. Borosilicates contain boron in place of aluminum, but generally there are some trace amounts of aluminum present in crystalline borosilicates.

Still further crystalline silicates which can be used in the present invention are iron silicates and gallium silicates.

Borosilicates and aluminosilicates are the more preferred silicates for use in the present invention. Aluminosilicates are the most preferred.

Silicalite is a particularly preferred aluminosilicate for use as the final stage catalyst of the present invention.

As synthesized, silicalite (according to U.S. Pat. No. 4,061,724) has a specific gravity at 77° F. of 1.99±0.05 g/cc as measured by water displacement. In the calcined form (1112° F. in air for one hour), silicalite has a specific gravity of 1.70±0.05 g/cc. With respect to the mean refractive index of silicalite crystals, values obtained by measurement of the as synthesized form and the calcined form (1112° F. in air for one hour) are 1.48±0.01 and 1.39±0.01, respectively.

The X-ray powder diffraction pattern of silicalite (1112° F. calcination in air for one hour) has six relatively strong lines (i.e., interplanar spacings). They are set forth in Table 2 ("S"-strong, and "VS"-very strong):

TABLE 2

| d-Å | Relative Intensity |
|---|---|
| 11.1 ± 0.2 | VS |
| 10.0 ± 0.2 | VS |
| 3.85 ± 0.07 | VS |
| 3.82 ± 0.07 | S |
| 3.76 ± 0.05 | S |
| 3.72 ± 0.05 | S |

Table 3 shows the X-ray powder diffraction pattern of a typical silicalite composition containing 51.9 mols of $SiO_2$ per mol of tetrapropyl ammonium oxide [$(TPA)_2O$], prepared according to the method of U.S. Pat. No. 4,061,724, and calcined in air at 1112° F. for one hour.

TABLE 3

| d-Å | Relative Intensity | d-Å | Relative Intensity |
|---|---|---|---|
| 11.1 | 100 | 4.35 | 5 |
| 10.02 | 64 | 4.25 | 7 |
| 9.73 | 16 | 4.08 | 3 |
| 8.99 | 1 | 4.00 | 3 |
| 8.04 | 0.5 | 3.85 | 59 |
| 7.42 | 1 | 3.82 | 32 |
| 7.06 | 0.5 | 3.74 | 24 |
| 6.68 | 5 | 3.71 | 27 |
| 6.35 | 9 | 3.64 | 12 |
| 5.98 | 14 | 3.59 | 0.5 |
| 5.70 | 7 | 3.48 | 3 |
| 5.57 | 8 | 3.44 | 5 |
| 5.36 | 2 | 3.34 | 11 |
| 5.11 | 2 | 3.30 | 7 |
| 5.01 | 4 | 3.25 | 3 |
| 4.98 | 5 | 3.17 | 0.5 |
| 4.86 | 0.5 | 3.13 | 0.5 |
| 4.60 | 3 | 3.05 | 5 |
| 4.44 | 0.5 | 2.98 | 10 |

Silicalite crystals in both the "as synthesized" and calcined forms are generally orthorhombic and have the following unit cell parameters:

$$a=20.05^{\perp}, b=19.86^{\perp}, c=13.36^{\perp} \text{ (all values } \pm 0.1 \text{ A).}$$

The pore diameter of silicalite is about 6⊥ and its pore volume is 0.18 cc/gram as determined by adsorption. Silicalite adsorbs neopentane (6.2⊥ kinetic diameter) slowly at ambient room temperature. The uniform pore structure imparts size-selective molecular sieve properties to the composition, and the pore size permits separation of p-xylene from o-xylene, m-xylene and ethylbenzene as well as separations of compounds having quaternary carbon atoms from those having carbon-to-carbon linkages of lower value (e.g., normal and slightly branched paraffins).

The crystalline silicates of U.S. Pat. No. Re. 29,948 (Reissue of U.S. Pat. No. 3,702,886 to Argauer) are disclosed as having a composition, in the anhydrous state, as follows:

$$0.9\pm0.2\ (xR_2O+(1-x)M_{2/n}O]:<0.005\ Al_2O_3:>1SiO_2$$

where M is a metal, other than a metal of Group IIIA, n is the valence of said metal, R is an alkyl ammonium radical, and x is a number greater than 0 but not exceeding 1. The crystalline silicate is characterized by the X-ray diffraction pattern of Table 1, above.

The crystalline silicate polymorph of U.S. Pat. No. 4,073,865 to Flanigan et al. is related to silicalite and, for purposes of the present invention, is regarded as being in the ZSM-5 class. The crystalline silicate exhibits the X-ray diffraction pattern of Table 4.

TABLE 4

| d(⊥) | Intensity |
|---|---|
| 11.14 | 91 |
| 10.01 | 100 |
| 9.75 | 17 |
| 8.99 | 1 |
| 8.01 | 0.5 |
| 7.44 | 0.5 |
| 7.08 | 0.2 |
| 6.69 | 4 |
| 6.36 | 6 |
| 5.99 | 10 |
| 5.71 | 5 |
| 5.57 | 5 |
| 5.37 | 1 |
| 5.33 | 1 |
| 5.21 | 0.3 |
| 5.12 | 1.5 |
| 5.02 | 3 |
| 4.97 | 6 |
| 4.92 | 0.6 |
| 4.72 | 0.5 |
| 4.62 | 2 |
| 4.47 | 0.6 |
| 4.36 | 3 |
| 4.25 | 4 |
| 4.13 | 0.5 |
| 4.08 | 1.5 |
| 4.00 | 3 |
| 3.85 | 44 |
| 3.82 | 25 |
| 3.71 | 21 |
| 3.65 | 5 |
| 3.62 | 5 |
| 3.59 | 1 |
| 3.48 | 1.5 |
| 3.45 | 3 |
| 3.44 | 3 |
| 3.35 | 3 |
| 3.31 | 5 |
| 3.25 | 1.5 |
| 3.23 | 0.8 |
| 3.22 | 0.5 |

According to the August 1979 Nature reference cited above, a silicalite-2 precursor can be prepared using tetra-n-butylammonium hydroxide only, although adding ammonium hydroxide or hydrazine hydrate as a source of extra hydroxyl ions increases the reaction rate considerably. It is stable at extended reaction times in a hydrothermal system. In an example preparation, 8.5 mol $SiO_2$ as silicic acid (74% $SiO_2$) is mixed with 1.0 mol tetra-n-butylammonium hydroxide, 3.0 mol $NH_4OH$ and 100 mol water in a steel bomb and heated at 338° F. for three days. The precursor crystals formed are ovate in shape, approximately 2–3 microns long and 1–1.5 microns in diameter. It is reported that the silicalite-2 precursor will not form if Li, Na, K, Rb or Cs ions are present, in which case the precursor of the U.S. Pat. No. 4,061,724 silicalite is formed. It is also reported that the size of the tetraalkyklammonium ion is critical because replacement of the tetra-n-butylammonium hydroxide by other quaternary ammonium hydroxides (such as tetraethyl, tetrapropyl, triethylpropyl, and triethybutyl hydroxides) results in amorphous products. The amount of Al present in silicalite-2 depends on the purity of the starting materials and is reported as being less than 5 ppm. The precursor contains occluded tetraalkylammonium salts which, because of their size, are removed only by thermal decomposition. Thermal analysis and mass spectrometry show that the tetraalkylammonium ion decomposes as approximately 572° F. and is lost as the tertiary amine, alkene and water. This is in contrast to the normal thermal decomposition at 392° F. of the same tetraalkylammonium salt in air.

The Nature article further reports that the major differences between the patterns of silicalite and silicalite-2 are that peaks at 9.06, 13.9, 15.5, 16.5, 20.8, 21.7, 22.1, 24.4, 26.6 and 27.0 degrees 2h (CuK alpha radiation) in the silicalite X-ray diffraction pattern are absent from the silicalite-2 hydrate as a source of extra hydroxyl ions increases the reaction rate considerably. It is stable at extended reaction times in a hydrothermal system. In an example preparation, 8.5 mol $SiO_2$ as silicic acid (74% $SiO_2$) is mixed with 1.0 mol tetra-n-butylammonium hydroxide, 3.0 mol $NH_4OH$ and 100 mol water in a steel bomb and heated at 338° F. for three days. The precursor crystals formed are ovate in shape, approximately 2–3 microns long and 1–1.5 microns in diameter. It is reported that the silicalite-2 precursor will not form if Li, Na, K, Rb or Cs ions are present, in which case the precursor of the U.S. Pat. No. 4,061,724 silicalite is formed. It is also reported that the size of the tetraalkyklammonium ion is critical because replacement of the tetra-n-butylammonium hydroxide by other quaternary ammonium hydroxides (such as tetraethyl, tetrapropyl, triethylpropyl, and triethybutyl hydroxides) results in amorphous products. The amount of Al present in silicalite-2 depends on the purity of the starting materials and is reported as being less than 5 ppm. The precursor contains occluded tetraalkylammonium salts which, because of their size, are removed only by thermal decomposition. Thermal analysis and mass spectrometry show that the tetraalkylammonium ion decomposes as approximately 572° F. and is lost as the tertiary amine, alkene and water. This is in contrast to the normal thermal decomposition at 392° F. of the same tetraalkylammonium salt in air.

The Nature article further reports that the major differences between the patterns of silicalite and silicalite-2 are that peaks at 9.06, 13.9, 15.5, 16.5, 20.8, 21.7, 22.1, 24.4, 26.6 and 27.0 degrees 2h (CuK alpha radiation) in the silicalite X-ray diffraction pattern are absent from the silicalite-2 pattern. Also, peaks at 8.8, 14.8, 17.6, 23.1, 23.9 and 29.9 degrees are singlets in the silicalite-2 pattern rather than doublets as in the silicalite pattern. These differences are reported as being the same as those found between the aluminosilicate diffraction patterns of orthorhombic ZSM-5 and tetragonal ZSM-11. Unit cell dimensions reported as calculated on the assumption of tetragonal symmetry for silicalite-2 are a=20.04; b=20.04; c=13.38. The measured densities and refractive indices of silicalite-2 and its precursor are reported as 1.82 and 1.98 g/cc and 1.41 and 1.48 respectively.

For purposes of the present invention, silicalite is regarded as being in the ZSM-5 class, alternatively put, as being a form of ZSM-5 having a high silica to alumina ratio; silicalite-2 is regarded as being in the ZSM-11 class.

The preparation of crystalline silicates useful as final stage catalyst supports of the present invention generally involves the hydrothermal crystallization of a reaction mixture comprising water, a source of silica, and an organic templating compound at a pH of 10 to 14. Representative templating moleties include quaternary cations such as $XR_4$ where X is phosphorous or nitrogen and R is an alkyl radical containing from 2 to 6 carbon atoms, e.g., tetrapropylammonium hydroxide (TPA-OH) or halide, as well as alkyl hydroxyalkyl compounds, organic amines and diamines, and heterocycles such as pyrrolidine.

When the organic templating compound (i.e., TPA-OH) is provided to the system in the hydroxide form in sufficient quantity to establish a basicity equivalent to the pH of 10 to 14, the reaction mixture may contain only water and a reactive form of silica as additional ingredients. In those cases in which the pH must be increased to above 10, ammonium hydroxide or alkali metal hydroxides can be suitably employed for that purpose, particularly the hydroxides of lithium, sodium and potassium. The ratio: $R^+$ to the quantity $R^+$ plus $M^+$, where $R^+$ is the concentration of organic templating cation and $M^+$ is the concentration of alkali metal cation, is preferably between 0.7 and 0.98, more preferably between 0.8 and 0.98, most preferably between 0.85 and 0.98.

The source of silica in the reaction mixture can be wholly, or in part, alkali metal silicate. Other silica sources include solid reactive amorphous silica, e.g., fumed silica, silica sols, silica gel, and organic orthosilicates. One commercial silica source is Ludox AS-30, available from Du Pont.

Aluminum, usually in the form of alumina, is easily incorporated as an impurity into the crystalline silicate. Aluminum in the crystalline silicate contributes acidity to the catalyst, which is undesirable. To minimize the amount of aluminum, care should be exercised in selecting a silica source with a minimum aluminum content. Commercially available silica sols can typically contain between 500 and 700 ppm alumina, whereas fume silicas can contain between 80 and 2000 ppm of alumina impurity. As explained above, the silica to alumina molar ratio in the crystalline silicate of the catalyst useful as the final stage catalyst is preferably greater than 500:1, more preferably greater than 1000:1, most preferably greater than 2000:1.

The quantity of silica in the reaction system is preferably between about 1 and 10 mols $SiO_2$ per mol-ion of the organic templating compound. Water should be generally present in an amount between 20 and 700 mol per mol-ion of the quaternary cation. The reaction preferably occurs in an aluminum-free reaction vessel which is resistant to alkali or base attack, e.g., Teflon.

In forming the final stage catalyst the crystalline silicate is preferably bound with a matrix. The term "matrix" includes inorganic compositions with which the silicate can be combined, dispersed, or otherwise intimately admixed. Preferably, the matrix is not catalytically active in a hydrocarbon cracking sense, i.e., contains substantially no acid sites. Satisfactory matrices include inorganic oxides. Preferred inorganic oxides include alumina, silica, naturally occurring and conventionally processed clays, for example bentonite, kaolin, sepiolite, attapulgite, and halloysite. The preferred matrices have few, if any, acid sites and therefore have little or no cracking activity. Silica or alumina are especially preferred. The use of a non-acidic matrix is preferred to maximize aromatics production.

Compositing the crystalline silicate with an inorganic oxide matrix can be achieved by any suitable method wherein the silicate is intimately admixed with the oxide while the latter is in a hydrous state (for example, as a hydrous salt, hydrogel, wet gelatinous precipitate, or in a dried state, or combinations thereof). A convenient method is to prepare a hydrous mono or plural oxide gel or cogel using an aqueous solution of a salt or mixture of salts (for example, aluminum sulfate and sodium silicate). Ammonium hydroxide carbonate (or a similar base) is added to the solution in an amount sufficient to precipitate the oxides in hydrous form. Then, the precipitate is washed to remove most of any water soluble salts and it is thoroughly admixed with the silicate which is in a finely divided state. Water or a lubricating agent can be added in an amount sufficient to facilitate shaping of the mix (as by extrusion).

A preferred crystalline silicate for use as the final stage catalyst is ZSM-5 having a high silica to alumina ratio, which, for convenience, is frequently referred to herein as "silicalite." Assuming that the only crystalline phase in the silicalite preparation is silicalite, the silicalite preferably has a percent crystallinity of at least 80%, more preferably at least 90%, most preferably at least 95%. To determine percent crystallinity, an X-ray diffraction (XRD) pattern of the silicalite is made and the area under the eight major peaks is measured in the angle interval between 20.5 and 25.0 degrees. Once the area under the curve is calculated, it is compared with the area under the curve for a 100% crystalline standard for silicalite.

The preferred crystallite size of the crystalline silicate is less than 10 microns, more preferably less than 5 microns, still more preferably less than 2 microns, and most preferably less than 1 micron. When a crystallite size is specified, preferably at least 70 wt. % of the crystallites are that size, more preferably at least 80 wt. %, more preferably 90 wt. %. Crystallites size can be controlled by adjusting synthesis conditions, as known to the art. These conditions include temperature, pH, and the mole ratios $H_2O/SiO_2$, $R^+/SiO_2$, and $M^+/SiO_2$, where $R^+$ is the organic templating cation and $M^+$ an alkali metal cation. For small crystallite size, i.e., less than 10 microns, typical synthesis conditions are listed below:

| | Preferred | More Preferred | Most Preferred |
|---|---|---|---|
| Temp., °F. | 176–392 | 144–356 | 212–302 |
| pH | 12–14 | 12.5–14 | 13–13.5 |
| $H_2O/SiO_2$ | 5–100 | 10–50 | 10–40 |
| $R^+/SiO_2$ | 0.1–1.0 | 0.1–0.5 | 0.2–0.5 |
| $M^+/SiO_2$ | 0.01–0.3 | 0.01–0.15 | 0.01–0.08 |

Other techniques known to the art, such as seeding with silicate crystals, can be used to reduce crystallite size.

The crystalline silicate component of the catalyst has an intermediate pore size. By "intermediate pore size" as used herein is meant an effective pore aperture in the range of about 5 to 6.5⊥ when the silicate is in the H-form. Crystalline silicates having pore apertures in this range tend to have unique molecular sieving characteristics. Unlike small pore crystalline silicates or zeolites such as erionite, they will allow hydrocarbons having some branching into the zeolitic void spaces. Unlike large pore zeolites such as the faujasites, they can differentiate between n-alkanes and slightly branched alkanes on the one hand and larger branched alkanes having, for example, quaternary carbon atoms.

The effective pore size of the crystalline silicates or zeolites can be measured using standard adsorption techniques and hydrocarbonaceous compounds of known minimum kinetic diameters. See Breck, *Zeolite Molecular Sieves*, 1974 (especially Chapter 8), and Anderson, et al., J. Catalysis 58, 114 (1979), both of which are incorporated by reference.

Intermediate pore size crystalline silicates or zeolites in the H-form will typically admit molecules having kinetic diameters of 5 to 6⊥ with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5⊥ can be admitted into the pores, depending on the particular zeolite, but do not penetrate as quickly and in some cases, are effectively excluded (for example, 2,2-dimethylbutane is excluded from H-ZSM-5). Compounds having kinetic diameters in the range of 6 to 6.5⊥ include: cyclohexane (6.0), m-xylene (6.1) and 1,2,3,4-tetramethylbenzene (6.4). Generally, compounds having kinetic diameters of greater than about 6.5⊥ cannot penetrate the pore apertures and thus cannot be adsorbed in the interior of the zeolite. Examples of such larger compounds include: o-xylene (6.8), hexamethylbenzene (7.1), 1,3,5-trimethylbenzene (7.5), and tributylamine (8.1).

Examples of intermediate pore size zeolites include silicalite and members of the ZSM series such as ZSM-5, ZSM-11, ZSM-12, ZSM-21, ZSM-22, ZSM-23, ZSM-35 and ZSM-38. The preferred effective pore size range is from about 5.3 to about 6.2⊥. ZSM-5, ZSM-11 and silicalite, for example, fall within this range.

In performing adsorption measurements to determine pore size, standard techniques are used. It is convenient to consider a particular molecule as excluded if it does not reach at least 95% of it equilibrium adsorption value on the zeolite in less than about 10 minutes (P/Po=0.5 25° C.).

The catalysts used in processes optimized according to the present invention generally contain one or more noble metals. Preferred metals are rhodium, palladium, iridium or platinum. Palladium, and platinum are more preferred. Platinum is most preferred. The preferred percentage of the noble metal, such as platinum, in the catalyst is between 0.1 wt. % and 5 wt. %, more preferably from 0.3 wt. % to 2.5 wt. %.

Noble metals are preferably introduced into the crystalline silicate by impregnation, occlusion, or exchange in an aqueous solution or exchange in an aqueous solution of an appropriate salt. When it is desired to introduce two Group VIII metals into the crystalline silicate, the operation may be carried out simultaneously or sequentially. Preferably, the Group VIII metal is finely dispersed within, and on, the crystalline silicate.

By way of example, platinum can be introduced by impregnation with an aqueous solution of tetraammineplatinum (II) nitrate, tetraammineplatinum (II) hydroxide, dinitrodiaminoplatinum or tetraammineplatinum (II) chloride. In an ion exchange process, platinum can be introduced by using cationic platinum complexes such as tetraammineplatinum (II) nitrate. When platinum is introduced into the silicalite by occlusion, a platinum complex is preferably introduced into the crystalline silicate during its formation.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A process for catalytically increasing the aromatic content of a hydrocarbon feed containing $C_6$-$C_8$ non-aromatic hydrocarbons, in a multistage operation, comprising:

contacting the feed in a penultimate stage under catalytic aromatic forming conditions with a first catalyst comprising a Group VIII metal dispersed on an inorganic oxide support to produce a penultimate stage effluent; and contacting the effluent from the penultimate stage in a final stage under catalytic aromatic producing conditions and at substantially the same pressure as is maintained in the penultimate stage with a second catalyst comprising a noble metal dispersed on an inorganic oxide support; and wherein said pressure in said penultimate and final stages is selected to provide optimal aromatic barrel per calendar day production from said final stage.

2. A process as set forth in claim 1, wherein the aromatic forming conditions include a pressure in a range from about 30 psig to about 350 psig.

3. A process as set forth in claim 1, wherein the penultimate stage effluent aromatic content is selected such that the run lengths between regenerations or replacements of said first and second catalysts in said penultimate and final stages are substantially equal.

4. A process as set forth in claim 3, wherein the pressure is selected to optimize the octane barrel per calendar day production of final stage product of a selected Research Octane Number.

5. A process as set forth in claim 3, wherein the Research Octane Number of the final stage product is at least about 100.

6. A process as set forth in claim 3, wherein the Research Octane Number of the final stage product is at least about 101.

7. A process as set forth in claim 3, wherein said second catalyst is tolerant to up to 0.5 ppm sulfur on a continuous basis and to periodic exposure to up to 100 ppm sulfur.

8. A process as set forth in claim 3, wherein said first catalyst comprises platinum on alumina, silica/alumina or a zeolite and said second catalyst comprises platinum on an intermediate pore size zeolite.

9. A process as set forth in claim 8, wherein said intermediate pore size zeolite comprises silicalite, ZSM-5, ZSM-11, ZSM-12, ZSM-22, ZSM-23, ZSM-35, ZSM-38 or ZSM-48.

10. A process as set forth in claim 9, wherein said intermediate pore size zeolite comprises ZSM-5.

11. A process as set forth in claim 9, wherein said zeolite comprises silicalite with a silica to alumina ratio of at least 200.

12. A process as set forth in claim 11, wherein said silicalite has less than 5,000 ppm alkali.

13. A process as set forth in claim 9, wherein said zeolite comprises silicalite with a silica to alumina ratio of at least 500.

14. A process as set forth in claim 13, wherein said silicalite has less than 5,000 ppm alkali.

* * * * *